US011208893B2

(12) United States Patent
Plante et al.

(10) Patent No.: US 11,208,893 B2
(45) Date of Patent: Dec. 28, 2021

(54) HIGH TEMPERATURE CERAMIC ROTARY TURBOMACHINERY

(71) Applicant: Ceragy Engines Inc., Glenview, IL (US)

(72) Inventors: Jean-Sébastien Plante, Sherbrooke (CA); Mathieu Picard, Sherbrooke (CA); Alexandre Landry-Blais, Cantons de Hatley (CA); Hugo Fortier-Topping, Sherbrooke (CA); Michael Gurin, Glenview, IL (US); Céderick Landry, Sherbrooke (CA); Patrick Dubois, Sherbrooke (CA); Luc G. Frechette, Sherbrooke (CA); Benoit Picard, Sherbrooke (CA)

(73) Assignee: SOCPRA SCIENCES ET GENIE S.E.C., Sherbrooke (CA)

( * ) Notice: Subject to any disclaimer, the term of this patent is extended or adjusted under 35 U.S.C. 154(b) by 780 days.

(21) Appl. No.: 15/361,351

(22) Filed: Nov. 25, 2016

(65) Prior Publication Data

US 2017/0074102 A1 Mar. 16, 2017

Related U.S. Application Data

(63) Continuation-in-part of application No. 15/164,642, filed on May 25, 2016.

(Continued)

(51) Int. Cl.

| | |
|---|---|
| ***F01D 5/28*** | (2006.01) |
| ***F01D 5/02*** | (2006.01) |
| ***F01D 5/30*** | (2006.01) |

(52) U.S. Cl.

CPC ..... *F01D 5/025* (2013.01); *F01D 5/284* (2013.01); *F01D 5/3084* (2013.01); *F05D 2220/32* (2013.01); *F05D 2300/20* (2013.01)

(58) Field of Classification Search

CPC ..... F01D 5/3007; F01D 5/225; F01D 5/22; F01D 5/3084; F01D 5/284; F01D 5/28; F02K 7/16; F02C 3/165

See application file for complete search history.

(56) References Cited

U.S. PATENT DOCUMENTS

| | | | |
|---|---|---|---|
| 2,471,892 | A | 5/1949 | Price |
| 2,530,281 | A | 11/1950 | Barsby |

(Continued)

FOREIGN PATENT DOCUMENTS

| | | | |
|---|---|---|---|
| GB | 778855 | A | 7/1957 |
| GB | 2 069 065 | A | 8/1981 |

(Continued)

OTHER PUBLICATIONS

R. Kochendorfer—Compression Loaded Ceramic Turbine Rotor—Published Mar. 1980 Technical Editing and Reproduction Ltd, Harford House, 7-9 Charlotte St, London, W JP JHD Institut fur Bauweisen—und, Konstruktionsforschung/ DFVLR, Forschungszentrum Stuttgart, 7000 Stuttgart-80 (Vaihingen), Pfaffenwaldring 38/40, Germany.

(Continued)

*Primary Examiner* — Justin D Seabe

(74) *Attorney, Agent, or Firm* — Norton Rose Fulbright Canada LLP

(57) ABSTRACT

The present invention generally relates to rotary turbomachinery methods and integrated processes requiring high-energy efficiency. In one embodiment, the present invention relates to rim-rotor configurations enabling long-term survival under conditions of either high temperature or oxidation resistance or saturated fluid abrasion.

21 Claims, 17 Drawing Sheets

Related U.S. Application Data

(60) Provisional application No. 62/166,124, filed on May 25, 2015.

(56) References Cited

U.S. PATENT DOCUMENTS

| | | | | |
|---|---|---|---|---|
| 3,754,839 | A | 8/1973 | Bodman | |
| 4,017,209 | A * | 4/1977 | Bodman | F01D 5/187 416/97 R |
| 4,111,603 | A * | 9/1978 | Stahl | F01D 5/22 416/95 |
| 4,580,943 | A * | 4/1986 | Scully | F01D 5/08 415/116 |
| 5,557,922 | A | 9/1996 | Hoshino et al. | |
| 7,393,182 | B2 | 1/2008 | Matheny | |
| 7,798,779 | B2 * | 9/2010 | Nogami | F01D 5/147 416/220 R |
| 8,459,953 | B2 * | 6/2013 | Haffner | F01D 5/3015 416/219 R |
| 8,696,320 | B2 * | 4/2014 | Harris, Jr. | F01D 5/26 416/244 R |
| 9,410,440 | B2 * | 8/2016 | Dimelow | F01D 5/303 |
| 2014/0238037 | A1 | 8/2014 | Cummings, III | |
| 2014/0290259 | A1 | 10/2014 | Plante et al. | |
| 2017/0074102 | A1 | 3/2017 | Plante et al. | |

FOREIGN PATENT DOCUMENTS

| | | | |
|---|---|---|---|
| GB | 2069065 | A | 8/1981 |
| WO | 2005017320 | A1 | 2/2005 |
| WO | 2013040679 | A1 | 3/2013 |

OTHER PUBLICATIONS

L.J. Stoffer—Novel Ceramic Turbine Rotor Concept—Final Technical Report Sep. 1979 General Electric Company, Aircraft Engine Group, Cincinnati, Ohio 45215 AFAPL-TR-79-2074.

* cited by examiner

HIGH TEMPERATURE CERAMIC ROTARY TURBOMACHINERY

CROSS-REFERENCE TO RELATED APPLICATIONS

This patent application claims priority from U.S. Provisional Patent Application No. 62/166,124 also titled "High G-field Combustion" on May 25, 2015, and U.S. patent application Ser. No. 15/164,642 also titled "High G-field Combustion" on May 25, 2016.

FIELD OF THE INVENTION

The present disclosure relates to rim-rotor turbomachinery where the combustion process predominantly takes place at high g-field forces and the turbine is radially supported by a composite, including carbon, reinforced rim-rotor that empowers the use of ceramics. Both technologies enable the increase of temperature including in a recuperated Brayton cycle to achieve high efficiency while maintaining low NOx levels. The rotary turbomachinery is perfectly suited for both compression and/or expansion in which severe conditions of high temperature, high oxygen or other flammable fluids, and/or highly saturated fluids creating abrasion are present independent of any integral combustion process/methods, notably the inventive high g-field combustion.

BACKGROUND OF THE INVENTION

Due to a variety of factors including global warming issues, fossil fuel availability and environmental impacts, crude oil price and availability issues, alternative combustors with or without power generation methods must be developed to reduce carbon dioxide (CO2) and nitrogen oxides (NOx) emissions.

When considering power generation cycles such as the recuperated Brayton cycle, it is recognized in the art that increasing cycle efficiency requires increasing combustion temperature, yet it is also known that increasing combustion temperature is accompanied by an increasing challenge of maintaining NOx emissions below environmental requirements. Typical gas turbines use lean premixed combustion to minimize the maximum flame temperature within the combustor and hence reduce NOx emissions. However, for recuperated cycles these combustors are limited to air preheat temperatures below the autoignition temperature of the fuel-air mixture to avoid instabilities which can ultimately lead to catastrophic failure of the combustor. Lean premixed combustors are thus restricted to lower recuperated cycle temperatures, lower cycle efficiencies and higher carbon dioxide emissions.

Mobile applications require compactness, minimal weight and volume.

Furthermore, another challenge with increasing the temperature of a recuperated Brayton cycle lies in the turbine itself, where typical alloys require large amounts of cooling to be able to withstand high gas temperatures. This is even more challenging for small scale turbines (<1 MW) where film cooling is very hard to implement and significantly reduces cycle efficiency. Attempts have been made to use ceramics, such as Silicon Nitride and Silicon Carbide, for gas turbines since these materials can withstand very high temperature, but due to their brittleness they show reliability issues. Prior attempts have been made to build ceramic turbines contained in a rim-rotor, such as U.S. Pat. No. 4,017,209, but do not propose a viable cooling solution for the composite rim-rotor, which is limited by glass transition for carbon-polymer composites, or oxidation for carbon-carbon composites. In this specific case, cooling air goes through long slender blades operating beyond 1200 C, meaning the air is inevitably pre-heated, and thus, unless massive mass flows are used, cannot perform any meaningful cooling to a composite rim-rotor having a maximum operating temperature in the 250-350 C range, making the approach useless for high-efficiency applications. These attempts have also been limited to purely axial turbine designs, which do not take full advantage of the rim-rotor that could be used for hub-less designs allowing inversed radial, axial or mixed flow configurations that optimize the temperature distribution of the engine packaging by keeping the hot gases on one single side of the turbine wheel, therefore separating structural and thermal loops.

Furthermore, when considering rim-rotor machinery, there is a significant challenge in matching the large displacement of the rim-rotor to the small displacement of a rigid hub. The rim-rotor also needs to be thermally insulated from the hot combustion gases, with ceramics being a choice candidate due to their low conductivity and high temperature resistance. Prior art exists showing attempts to design and build flexible, compliant hubs for rim-rotor machinery as well as thermal protection layers for the rim-rotor. Some of this prior art has been limited to conceptual designs with no experimental validation (G E, Stoffer 1979), or component failure during experimental validation (R. Kochendorfer 1980). These designs failed due to tensile loading of ceramics components under circumferential stress, and hence an improper use of the rim-rotor design to reduce, or even eliminate, the tensile stresses.

Accordingly, there is a need for a compact, low NOx combustor that can operate at high air preheat temperatures without the risk of instabilities or failures, that could be used in industrial (furnaces, heaters) and power applications such as distributed CHP, aerospace and automotive applications. For maximum efficiency and emissions benefits in power applications, this combustor would need to be used with rim-rotor ceramic turbomachinery allowing high combustion temperatures, and hence high cycle efficiency.

SUMMARY OF THE INVENTION

In a first aspect, the present disclosure provides a high g-field combustor whose embodiment can be in a static, rotating or otherwise accelerating reference frame. The combustor comprises fuel injection sites, flame-holding (or flame-stabilizing) devices, means of igniting the fuel-air mixture and means of generating a high g-field.

In a second aspect, the present disclosure provides a gas turbine configuration that uses a rim-rotor configuration to allow the use of ceramics under compression. The rim-rotor turbine comprises a high-strength composite rim-rotor, ceramic or high temperature insulating layer, ceramic or high temperature alloy aerodynamic blades, and a radially flexible hub.

DETAILED DESCRIPTION OF THE INVENTION

Figure 1:
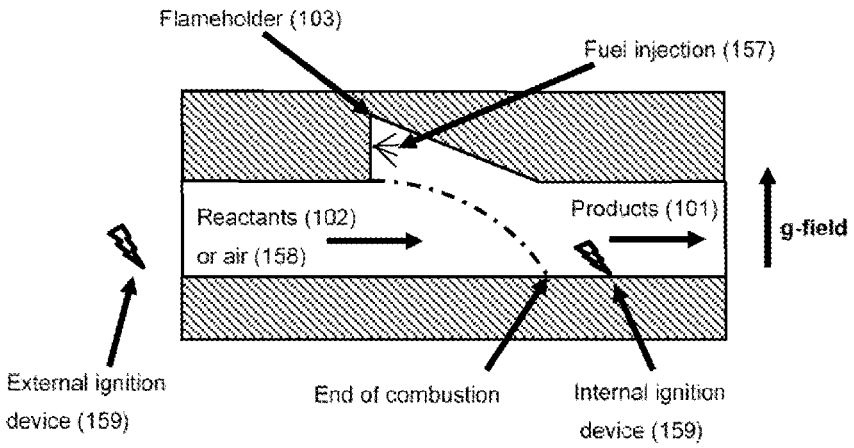
FIG. 1 is a schematic view illustrating the principal of operation of a high g-field combustor

Traditional flame propagation mechanism in combustion reactions is driven by turbulent mixing, buoyancy forces between reactants and products, and species diffusion. Under normal low g-field conditions, the buoyancy forces are very small and do not significantly contribute to the flame propagation. However, at high g-fields (at a minimal embodiment of g-field greater than 10,000 g's in which buoyant forces obtain meaningful mixing, and at the preferred embodiment of g-field greater than 100,000 g's in which buoyant forces are dominant), buoyancy forces between combustion products and reactants (or fuel and air) dominate the flame propagation mechanism by greatly increasing the Rayleigh-Taylor instabilities between the fluids, improving mixing between products and reactants and hence increasing the heat release rates. High g-field is the key element for fast mixing and thus short reaction distances and residence times. Furthermore, it is expected that a high g-field rotating combustor would be most beneficial for small scale turbomachinery (<1 MW) because for a given turbine tip speed the g-field is inversely proportional to the machine radius. This results in g-fields in the 100,000 g's for turbines in the 10 cm scale, and in over 1,000,000 g's for turbines in the 10 mm scale.

Conventional turbines normally use internally supported blades, i.e. blades that are supported at their root connected to a hub whose diameter is smaller than the root radius of the blade. Such configurations result in the blades being loaded under tensile stress due to the centrifugal forces occurring during rotation, which limits the blades to being made of materials having high tensile strength. These materials are typically metallic alloys that are limited to relatively low temperatures. High temperature materials such as ceramics cannot be used in conventional turbines due to their low tensile strength and high brittleness: any small crack present in the blade will rapidly grow and lead to failure of the turbine due to the tensile loading of the blades. To increase the efficiency of a recuperated Brayton cycle, it is desirable to increase the turbine inlet temperature to levels significantly higher than the maximum allowable blade temperature for metallic alloys. Conventional turbines can achieve this by using blade cooling strategies, but the manufacturing difficulties and efficiency penalties limits it's use to large-scale turbines (>1 MW). For small scale turbines, the only viable approach to increase the turbine inlet temperature is to use ceramic blades, which is only possible using a rim-rotor turbine by holding the blades on their outer radius, the blades are loaded in compression which inhibits crack growth in ceramics. A rim-rotor turbine thus greatly increases the reliability of ceramic blades, which allows an increase in turbine inlet temperatures without the added complexity and cost of blade cooling.

Example embodiments will now be described more fully with reference to the accompanying figures.

FIG. 1 depicts a high g-field combustor where the combustion reaction is driven by buoyant forces caused by a centrifugal acceleration field and the density difference between combustion products 101 and premixed reactants 102. The g-field can also be used for the mixing of air 158 and fuel 157 to achieve a homogeneous reactants mixture 102 before ignition: fuels heavier than air could be injected on the inner radii and lighter fuels on the outer radii to provoke mixing. High g-field is the key element for fast mixing, short reaction distances and short residence time. In the various contexts of use of a combustor, both cold and highly pre-heated air inlet situations exist. For cold air inlet (below fuel auto-ignition temperature), both non-premixed and premixed combustion need a flame holding device 103 and an ignition device that can be within the g-filed 159 or external to the g-field 195. Prior art (US 2014/0290259 A1) has shown that ignition devices such as glow plugs, spark plugs, sparkles or pilot flames can be used. For hot air inlet (above fuel auto-ignition temperature), only non-premixed combustion is possible and has no need for a flame holding device 103 nor an internal ignition device 159 within the combustor. A flame holding device 103 and internal ignition device 159 may optionally be used for start-up modes until the temperature exceeds the fuel auto-ignition temperature when using a heat-exchanger to pre-heat the combustion air from the exhaust gases.

Figure 2:
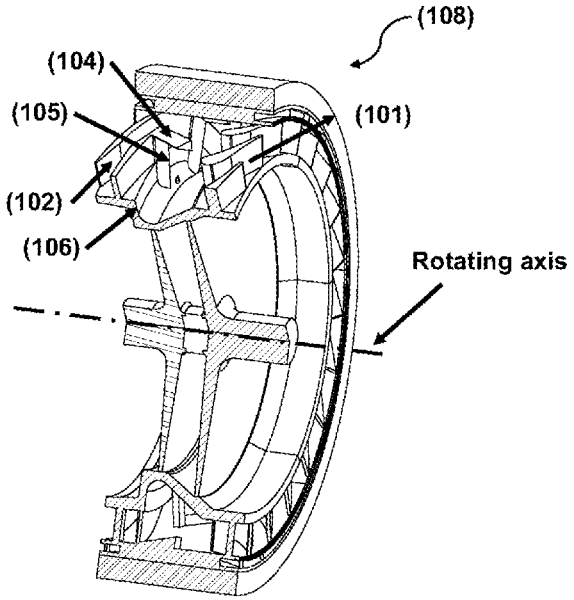
FIG. 2 is a cutaway view of an embodiment of a rotating high g-field combustor using a rim-rotor to support the various flame-holders required.

FIG. 2 is an embodiment of a high g-field combustor in a rotating configuration 108. The g-field is imposed by rotating the combustor around an axis, driving the heavier reactants 102 or air 158 outwards of the rotating axis and the hot combustion products 101 or fuel 157 inwards of the rotating axis. Multiple flame-holding devices such as an upper flame-holder 104, a vertical flame-holder 105 and a lower flame-holder 106 in reference to the g-field direction can be used to stabilize the flame within the combustor. The rotating combustor 108 can be operable with either premixed cold air inlet, non-premixed cold air inlet or non-premixed hot air inlet, with the fuel injection for non-premixed configuration occurring either just before or within the rotating frame.

Figure 3:
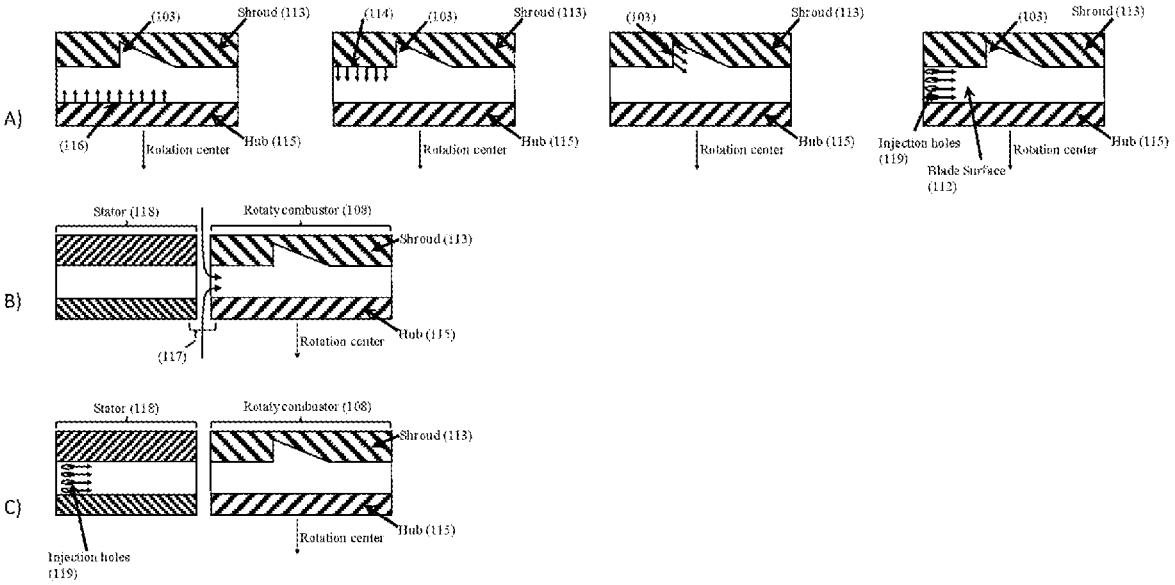
FIG. 3 is a schematic view illustrating the various fuel injection points possible within a high g-field combustor either in a static or rotating configuration.

The location of the chemical reaction within the combustor can be shaped by carefully placing multiple injection points in each flow channel of the main combustor. FIG. 3 shows the multiple location scenarios including: A) injection points within the rotating combustor (e.g. from the blades surface 112, from the shroud 113 inner surface 114, from the flame-holders 103 or from the hub 115 outer surface 116, with fuel being transferred to the rotating frame either from the hub or the shroud), B) injection points within the interface or gap 117 between the static inlet and rotating combustor, or C) injection points within the static inlet 118 or ahead of the static inlet from holes 119 in the channel walls. The inventive high g-field rim-rotor is the only configuration that enables injecting fuel from the shroud side, which is good for high g-field combustion since the combustion products 101 will naturally flow across the main flow. Preferably, most of the combustion is done in the rotating frame 108 to limit Rayleigh pressure losses associated with high speed flows.

Figure 4:
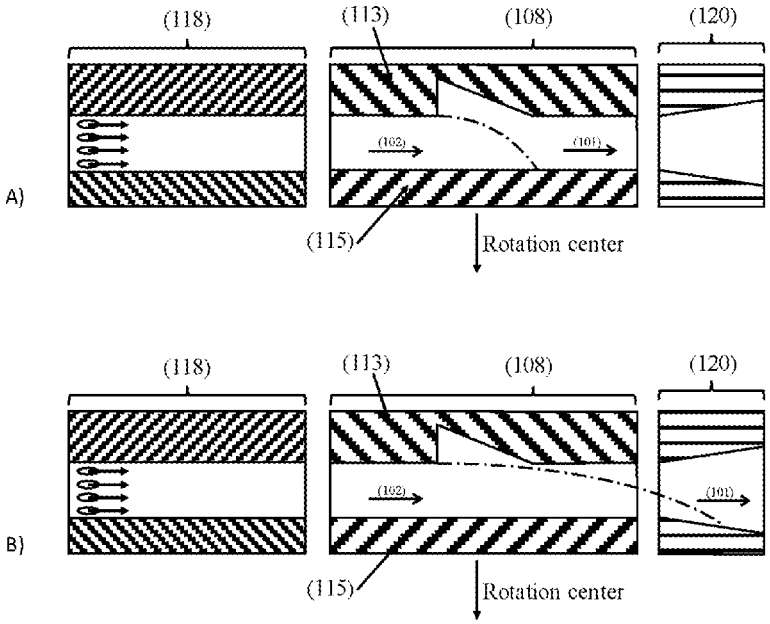
FIG. 4 is a schematic view illustrating how combustion can be fully completed within the high g-field combustor or only partially within the high g-field combustor and the remainder of the combustion reaction fully completed in a pressure expansion device to achieve isothermal expansion.

FIG. 4 shows two embodiments that can be used to design a rotating combustor 108: A) combustion can take place only in the combustor 108 at a constant pressure or B) combustion can be initiated and stabilized in the combustor 108 and can "continuously" take place during a pressure expansion in an expansion device such as a turbine 120 in which work is extracted by means of shaft power. It is understood that "continuous" combustion is when at least 1% of the combustion occurs concurrently with expansion, though preferably continuous combustion is at least 15% of the combustion occurs concurrently with expansion, particularly preferred is continuous combustion is at least 50% occurs concurrently with expansion, specifically preferred is continuous combustion is at least 90% occurs concurrently with expansion. And the absolute best configuration is in which 100% of the combustion takes place concurrently with expansion to achieve full/complete isothermal expansion for the highest thermodynamic efficiency of a shaft power device.

Figure 5:
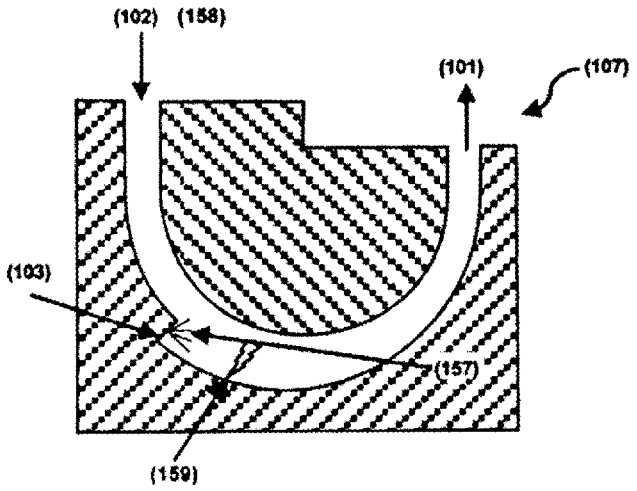
FIG. 5 is a schematic view of a static high g-field combustor.

FIG. 5 depicts a high g-field combustor in a static 107 configuration. Reactants 102 or air 159 enter the combustion chamber and are submitted to centrifugal acceleration due to the curvature of the combustion chamber. An outward positioned flame-holder 103 located in the curvature, hence in the g-field, is used to stabilize the flame in the case of premixed combustion. For non-premixed combustion, fuel injection 157 is done within the g-field without a flame-holder (or optionally with a flame-holder solely as a pilot flame-holder or for enhanced flame stabilization). The colder, denser reactants 102 are driven towards the outer radius of the channel whereas the hotter, less dense combustion products 101 are driven inwards. The static configuration can be operable with either cold air or premix inlet, or hot air inlet. For cold intake, an internal ignition device 159 such as a spark plug can be used to ignite the mixture. For hot intake, the ignition device 159 may optionally be used during start-up modes.

Figure 6:
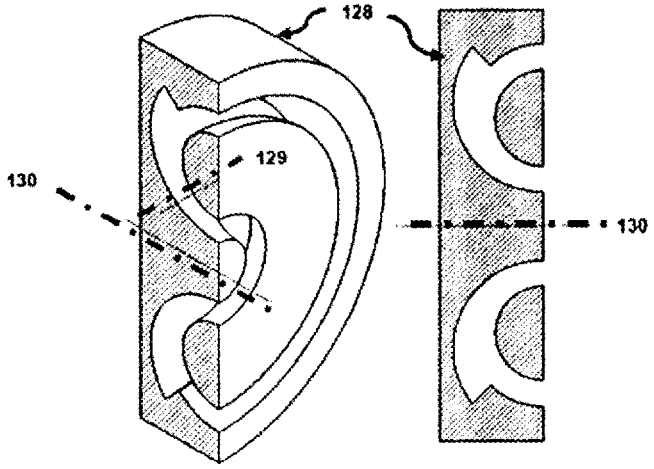
FIG. 6 is a schematic view of a possible embodiment of a high g-field combustor used for a gas turbine application in which the curvature radius of the high g-field combustor can be different than the radius of the turbine, allowing optimum configuration of flow velocity and g-field.

FIG. 6 is an embodiment of a static high g-field combustor 128, where the g-field is created in a non-rotating reference frame by turning the flow around an axis 129 that is perpendicular to the inlet/outlet flow axis 130, is the latter also being the rotation axis of turbomachinery at the combustor outlet. Previous attempts of similar combustors have been limited to swirling type combustors using channels wrapped around the turbine axis of rotation in a way such that the channels and the turbine basically have the same radii and are concentric. This limits the radius of curvature that can be used for the combustor, and results in a sub-optimal combination of velocity, pressure losses, and number of g's. A first order model can be drawn to illustrate this sub-optimal operation. The radius of curvature of a static g-field combustor $r_c$, depends on the flow Mach number M, inlet temperature $T_{in}$, and desired acceleration a, such that $$r_c = \frac{M^2 \gamma R T_{in}}{a}$$

where R and γ are gas properties. When designing for ideal design parameters, for example preferred design values of M<0.3 and a>100,000 g's, and a fixed inlet temperature $T_{in}$, the radius of curvature is found to be unrelated to the turbine radius such as in prior art. Hence prior art designs imply sub-optimal solutions by constraining the radius to be equal to the radius of the turbine. The embodiment shown in FIG. 6 allows the use of different flow radius for the high g-combustor and the turbine. The preferred ratio of turbine radius to combustor radius is greater than 2, the particularly preferred ratio of turbine radius to combustor radius is greater than 5, and the specifically preferred ratio is greater than 10. The larger power rating of the turbomachinery yields a higher turbine radius to combustor radius ratio.

Figure 7:
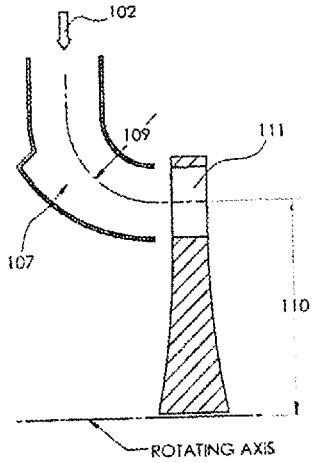
FIG. 7 is a schematic cut view of a high g-field combustor used with a turbine.

FIG. 7 shows a cutaway of a preferred embodiment of a static g-field combustor 107. To generate high g-fields in static combustors, preference is to have a small radius rather than increasing the velocity to limit Fanno and Rayleigh losses. Preference is for the radius of combustion chamber 109 to always be equal or smaller than the radius 110 of the turbine 111 preferably by at least 10%.

Figure 8:
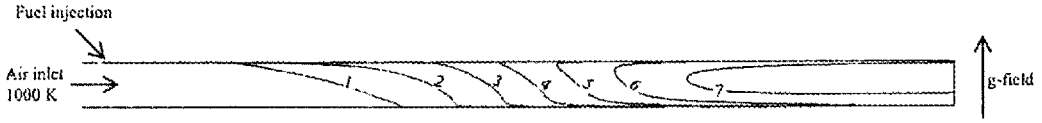
FIG. 8 is a CFD result showing NOx concentration contours in ppm in a channel submitted to a large g-field of 100,000 g's in which fuel is injected from the top into a hot air at 1000 K stream and combustion fully takes place within the channel.
Figure 9:
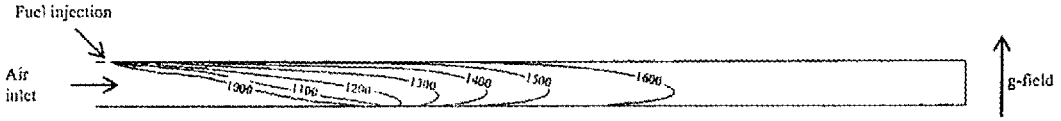
FIG. 9 is a CFD result showing Temperature contours in degrees K in a channel submitted to a large g-field of 100,000 g's in which fuel is injected from the top into a hot air at 1000 K stream and combustion fully takes place within the channel.

FIG. 8 and FIG. 9 show the results of CFD analysis of methane non-premixed combustion at a g-field of 100,000 g's. NOx concentration in ppm is shown in FIG. 8 and temperature contour in degrees Kelvin is shown in FIG. 9. In the simulations, the g-field is imposed on the reference frame as gravity and fuel injection is done in hot air at 1000 K to achieve non-premixed combustion at overall lean conditions. The results show that very low NOx concentration below 10 ppm is achieved even for combustion temperatures above 1600 K due to very good mixing resulting in low residence time at near-stoichiometric conditions.

Figure 10:
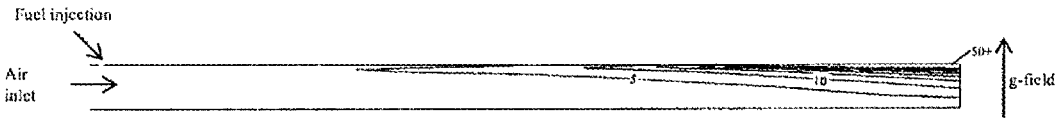
FIG. 10 is a CFD result showing NOx concentration contours in ppm in a channel submitted to a small g-field of 10,000 g's in which fuel is injected from the top into a hot air at 1000 K stream and combustion only partially takes place within the channel.
Figure 11:
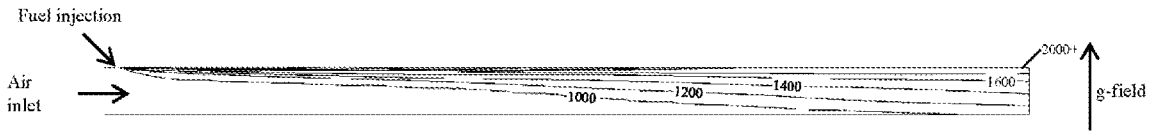
FIG. 11 is a CFD result showing Temperature contours in degrees K in a channel submitted to a small g-field of 10,000 g's in which fuel is injected from the top into a hot air at 1000 K stream and combustion only partially takes place within the channel.

FIG. 10 and FIG. 11 show the CFD analysis under the same conditions but at a lower g-field of 10,000 g's. The results show that the temperature is higher than 2000 K, resulting in high NOx concentration above 50 ppm, which is due to poor mixing and long reaction lengths at lower g-fields resulting in higher residence time at near-stoichiometric conditions. High g-field clearly enables a reduction in NOx concentration as well as combustor compactness by at least 50%. The preferred embodiment of the invention has g-fields of at least 100,000 g's in order to have a short combustion distance and corresponding low NOx emissions. The preferred embodiment further maintains a flow Mach number below 0.3 in order to limit Fanno and Rayleigh losses.

Figure 12:
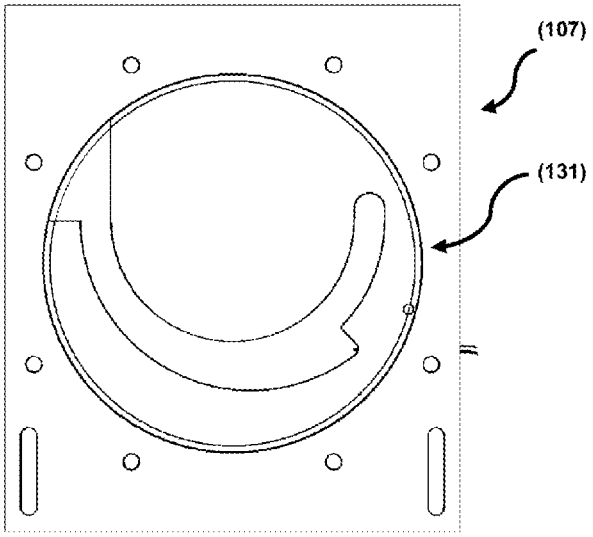
FIG. 12 is an embodiment of a high g-combustor used for high radiant applications.

A high radiant combustion process would emit combustion energy in the form of emitted radiation outside of the combustion chamber. High emissivity is preferred (preferably with emissivity greater than 30%, particularly preferred with emissivity greater than 70%, and specifically preferred with emissivity greater than 85%) when the high g-field combustor is utilized for industrial applications including: top cycle or bottom cycle for high radiant processes or industrial processes that can achieve higher production throughput by high radiant heat transfer (e.g., steel, glass, cement, etc.) or higher efficiency in the combination of solid-state energy conversion (e.g., thermophotovoltaic, thermoelectric, photovoltaic, etc.). A standalone high radiant and high g-field combustor with solid-state energy conversion significantly increases emitted energy while uniquely limiting the production of NOx formation. It is understood that the radiated/emitted energy is enabled by using designs with radiation transparent materials and/or by providing an obstacle free path. Such a design is shown in FIG. 12 where a static high g-field combustor 107 has a radiation transparent container 131 that allows high radiant combustion.

Figure 13:
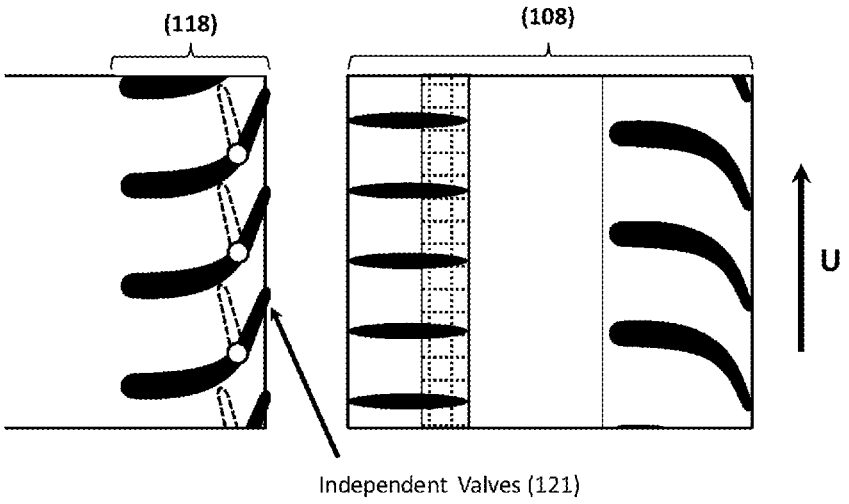
FIG. 13 is a schematic view of a rotating high g-field combustor in which stator guide vanes can be individually closed to control the mass flow rate to the rotating combustor.

FIG. 13 shows a method of maintaining combustor performance, both static 107 and rotating 108, during load and/or rpm variations by blocking the number of stator 118 channels, with the objective being to keep pre-heated air temperature above fuel ignition temperature under all load condition when using a hot air combustor. Flow can be blocked with a slide valve or a butterfly valve 121 for at least one of the combustor channel passage, preferably all channel passages could be turned ON/OFF individually or collectively. An advantage here is that combustor performance can remain independent of load since each individual (or group of) combustor passage(s) can see a relatively constant mass flow rate. This is a key inventive feature of the highly compact high g-field combustor.

Figure 14:
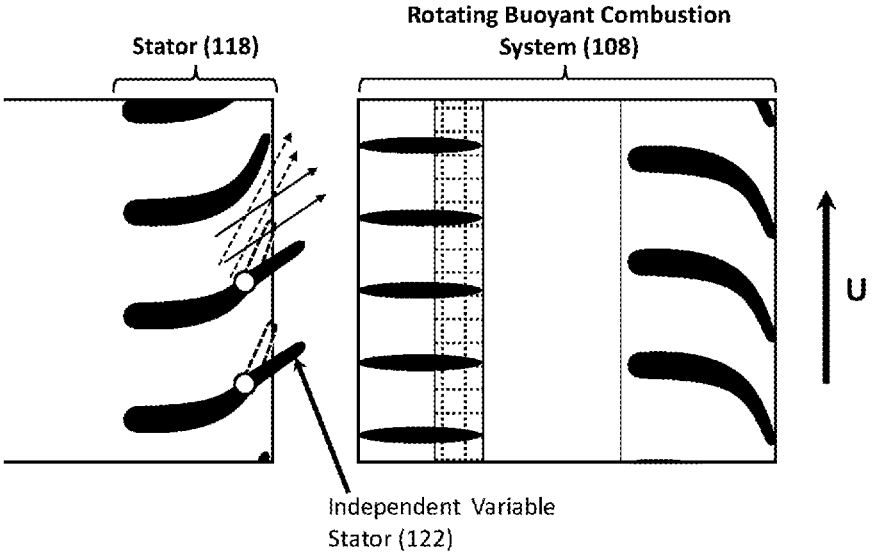
FIG. 14 is a schematic view of a rotating high g-field combustor in which stator guide vanes can be individually oriented to control tangential velocity of the flow to the rotating combustor.

FIG. 14 shows variable stator guide vanes 122 that can be used to change the flow's angular momentum at the stator 118 exit. The fuel injection system consists of multiple injection points 119 that can be turned ON/OFF individually or collectively as a subset of the total fuel injection points for flow modulation depending on operating conditions. Preferred injection point locations are: after the compressor and optional recuperator but before the main combustion chamber, one in each combustor channel of the main combustion chamber, and finally, after the turbine but before the recuperator. In all cases, injectors can be placed in curved channels and benefit from the piping's natural curvature (e.g. recuperator) to generate high g-fields. Another key feature of the invention is to place injectors to provide precise control of system ramp-up and ramp-downs for temperature control to mitigate thermal shock resistance issues on critical components (e.g. notably components made with ceramic materials). It is understood that the injectors will include an igniter such as when the autoignition temperature of the fuel is not reached or to alter the temperature profile within the high g-field combustor.

Figure 15:
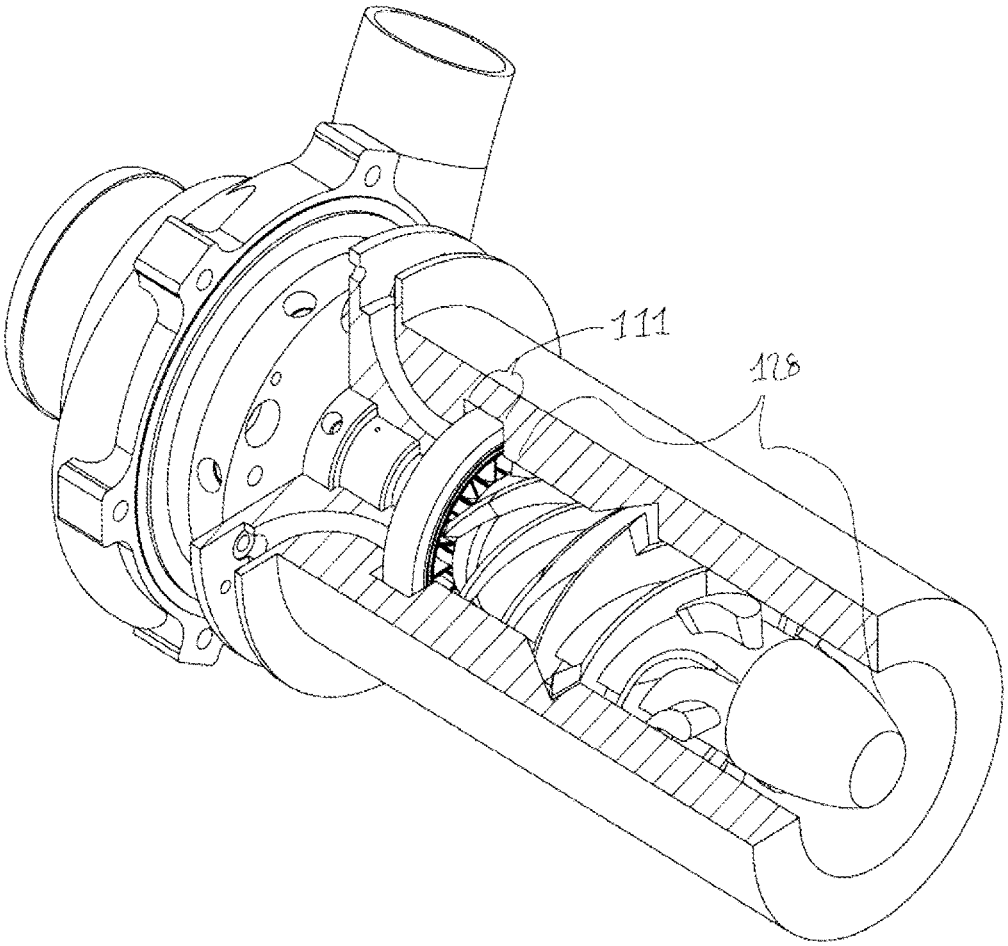
FIG. 15 is an embodiment of combining a static high g-field combustor with a ceramic rim-rotor turbomachine.

FIG. 15 shows the system combining the high g-field combustor 128 with a ceramic rim-rotor turbomachinery turbine 111, providing a very compact system with high thermodynamic efficiency capability. The short combustion length of the high g-field combustor together with a high temperature rim-rotor turbomachinery turbine consisting of at least one or more composite rings, at least two blades, a counter-flux thermal insulation substrate and whereby the at least two blades are retained under compressive loading, create a very short gas path between pre-combustion and post-expansion, therefore reducing thermal loss by at least 1% when compared to traditional combustor.

Figure 16:
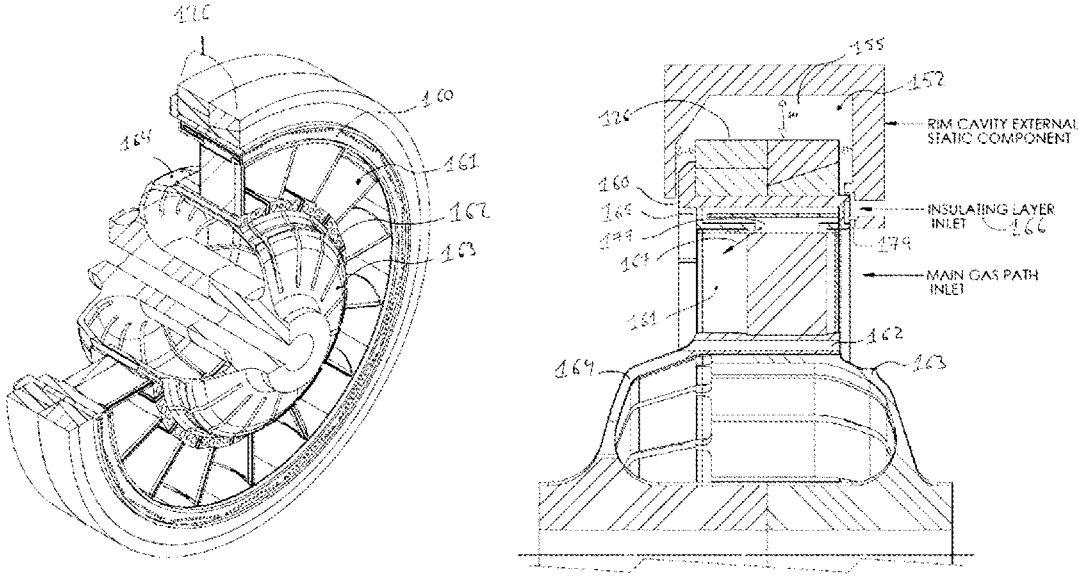
FIG. 16 is an embodiment of a rim-rotor turbomachine using a rim-rotor, counter-flux insulation substrate, ceramic blades and a compliant hub.

FIG. 16 shows the proposed construction of the rim-rotor turbomachinery turbine 111, which consists of an external rim-rotor 126, supportive shield 160, counter-flux thermal insulation substrate 165 and at least two aerodynamic blades 161, connected to a shaft through opposing arrays of radially compliant springs in the radial-axial plane 163 164. The external rim-rotor 126 can be made from an arrangement of one or more composite rings in the axial and/or radial axis and has the primary function of maintaining the at least two blades under compression loading. The radially compliant hub 163 164 requires at least one array of such compliant springs in order to provide adequate stiffness in all axis in order to be dynamically stable. The at least two blade 161 are in physical communication to the shaft through the at least one rotating array of radially compliant springs comprised of an at least one cantilevered beam in the radial-axial plane, whereby the at least two radially compliant springs are in physical communication with the at least two blades at the first axial position, and to the hub at a second axial position, and whereby the first axial position is different from the second axial position and the second axial position is located at a distance from the shaft greater by at least 0.01 inches from the first axial position. The radial compliance is adjusted by the length of the cantilever beams in the radial-axial plane. The stiffness can be selected by adjusted the thickness and profile of the beams, and if required a second set of beams can be added to largely increase the stiffness of the assembly. If required, the second set of beams can be joined by friction, permanently joined or made in a single piece. In the event where the spring in contact with the blade exceeds its material maximum temperature, cooling features that provide cooling flow directly under the blade 162 is the most effective method to maintain the hub structural integrity.

Figure 17:
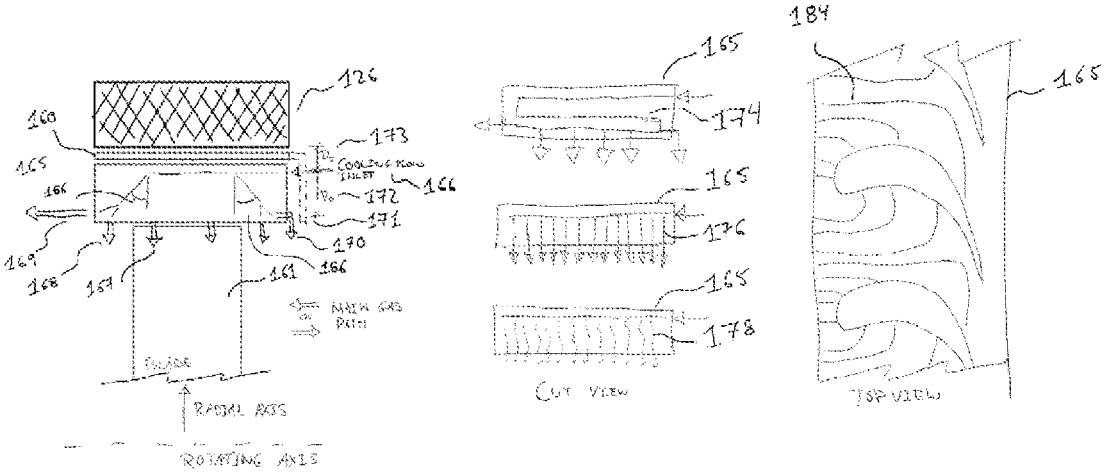
FIG. 17 is a schematic view of a counter-flux insulation substrate consisting of different cooling channel configuration.

The rim-rotor 126 is insulated by a counter-flux thermal insulation substrate 165, physically located between the rim-rotor and the at least two blades in order to maintain its temperature below its maximum operating temperature. The counter-flux thermal insulation substrate consist of at least two cooling channels, whereby the cooling fluid circulates, having a channel inlet and a channel outlet, whereby the center of the channel inlet 166 is located at a channel inlet distance "$D_I$" 173 from the rim-rotor inner surface to the channel inlet, whereby the channel outlet distance is located at a channel outlet distance "$D_O$+$D_I$" 172 from the rim-rotor inner surface, and whereby the channel inlet distance is at least 0.010 inches greater than the channel outlet distance. The cooling channels further have at least a portion of the channels that have a segment 186 that is at an angle between +45 and −45 from the radial axis. This configuration provides that at least a portion of the cooling flow is being directed radially toward the rotating axis (inward), which is against the dominant temperature gradient, therefore against the dominant conductive heat flux in the channel walls (i.e. counter-flux). Means of producing such radially inward flows are illustrated in FIG. 17. The insulation substrate 165 with at least a portion of the channels that have Z-shape channels 174, U-shape channels 177, micro-channel or micro-holes 176, porous material construction 178, or an arrangement of such. The substrate can be made from metals (e.g. titanium, superalloys), ceramics (e.g. Si3N4, SiC, Mullite, Al2O3, SiO2, ZrO2), blend of ceramics, ceramic coatings or a mix of those options. Superalloys are known in the art as high-performance alloys, being an alloy that exhibits several key characteristics: excellent mechanical strength, resistance to thermal creep deformation, good surface stability and resistance to corrosion or oxidation. In the case where porous material is used, open porosity is required to allow the cooling flow to circulate towards the main gas path. Low porosity, between 50% and 80% by mass, is preferred for material between the rim-rotor and the blade that are subject to compression loading. Higher porosity, between 20 and 50% by mass, is preferred where the insulation substrate is not in contact with the blade in order to reduce the substrate mass. Intricate small sizes required by the substrate optimal features consist of cooling channels of characteristic dimension between 0.004 and 0.040 inches. Preferred micro-holes dimensions are 0.001 to 0.020 inches.

Figure 18:
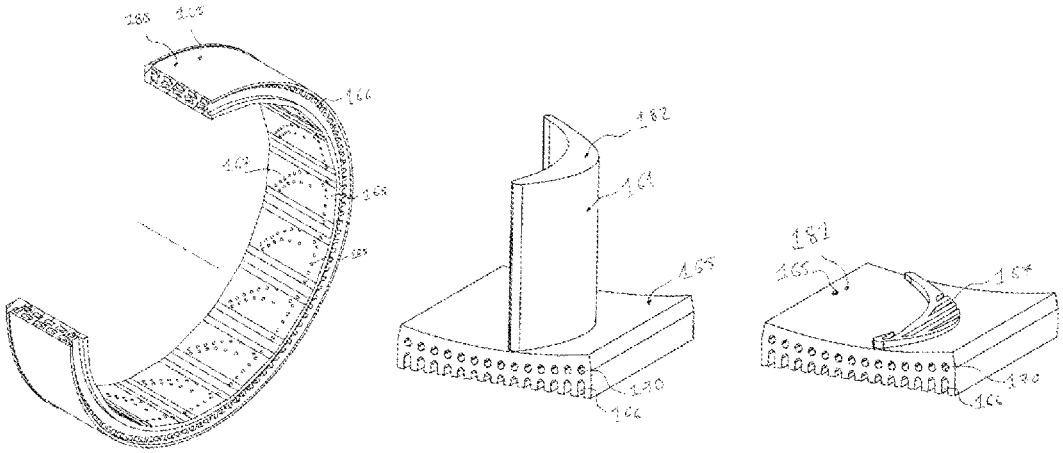
FIG. 18 is an embodiment of different counter-flux insulation substrates which can be manufactured using additive manufacturing methods.

FIG. 18 shows example of design implementing the advantages of additive manufacturing. By removing material at selected section(s), the insulation substrate consisting of a continuous monolithic material ring with intricate radially inwards flow channels 180 provides the low circumferential stiffness required to follow the rim-rotor circumferential expansion without breaking. This configuration is especially adapted to the additive manufacturing (also known as 3d printing manufacturing and used interchangeably throughout), but can also be fabricated using substractive manufacturing methods. This configuration also introduces radial micro-holes at selected position 185. A insulation substrate made of at least one layer of individual bricks 181 with complex cooling channels, which can also be produced with additive manufacturing or other manufacturing method, prevent the counter-flux thermal insulation layer from breaking due to rim-rotor circumferential expansion while undergoing centrifugal loading. In specific configurations, the optimal insulation substrate can be made with the same material as the at least two blades, and therefore the insulation substrate bricks or ring can be joined of directly fabricated together with at least one blade 182 by different method including soldering, casting, machining, additive manufacturing, diffusion bonding or laser welding. In given specific configuration, it is important to introduce a supportive shield 160 between the rim-rotor and the insulation substrate to distribute uniformly the centrifugal forces between substrate features and the rim-rotor, reducing the stress concentration at the contact of surfaces. The supportive shield 160 may provide axial constraints for the insulation substrate by incorporating at least one side will with positive locking features. The supportive shield 160, may also provide an effective mean of integrating different type of seals 179 having therefore a sealing function between the main flow and the cooling flow inlet to avoid hot gas being directed to the cooling channels and to reduce by at least 5% the amount of cooling fluid leaking in a non-cooling channel region (i.e., the main gas path), especially in configuration(s) where the insulating substrate is built from bricks and has tangential breaks or gaps. In addition, the supportive shield 160 is used in given embodiment(s) to provide a tightly controlled axial gap in front of one or more of the exit of the insulation substrate 171, which provides an effective mean of controlling the flow rates of small cooling flows. Gaps between the insulation substrate cooling channel outlet and the supportive shield ranging between 0.002 and 0.020 inches creates a flow area that provides adequate regulation of the cooling fluid flow rate. The supportive shield 160 can consist of one or more part to complete its function.

In order to reduce the amount of cooling flow, which directly impacts the efficiency of the turbomachinery, the counter-flux thermal insulation substrate is preferred to the prior art where only a mix of axial and tangential cooling flow is used. In a configuration where the rim-rotor in wounded from carbon fiber in a polymer matrix, the maximum operating temperature of the insulation substrate 165 is much greater than the maximum operating temperature of the rim-rotor 126, therefore the cooling flow exiting the insulation substrate which has inward radial feature allows the cooling flow to get up to the maximum temperature of the substrate and extract considerably higher amount of heat, having effectively a higher calorific capacity for a given flow rate. The axial and tangential cooling flow of the prior art is in direct or indirect thermal contact with the rim-rotor 126 until the channel exit, which limits the temperature of cooling flow to the maximum temperature of the rim-rotor itself, extracting less heat, and therefore requiring considerably higher amount of cooling flow. Furthermore, the cooling channel air flow is also self-stabilized due to the high-g field where the density difference between hot and cold fluid is such that the coldest fluid is sent toward the cooling channels inlet, and therefore protects the rim-rotor, while the hottest fluid is sent toward the cooling channel exit. The counter-flux insulation substrate would reduce the cooling flow required from approximately 5+% to less than 1% of the main flow, therefore by at least a 20% reduction in cooling flow up to the optimal and specifically preferred cooling flow reduction by at least 80%. Based on approximately 0.5 point of cycle efficiency loss per 1% of main flow used for cooling, the counter-flux insulation substrate results in efficiency gain of 2+ point on the cycle, therefore by at least a 0.5% of cycle efficiency up to the optimal of at least a 2.0% of cycle efficiency in the specifically preferred embodiment.

In addition to the benefit of the increase calorific capacity, the radial inward features allow at least a portion of the cooling flow to be used as transpiration cooling (preferably 50%, up to the optimal of 100% in the specifically preferred embodiment), effectively injecting cold air between the main gas path and the insulation substrate. This creates the film-cooling effect, defined by an insulating layer of cold air between the surface of the insulating substrate and the hot main flow to reduce wall temperatures and thus heat flux. This effect is typically used on turbine blades or static shroud surfaces, which are not radially inward in the rotating frame like in this embodiment. The high centrifugal forces, combined with the density difference between the injected cooling flow that is relatively cold and the main gas flow that is hot, provides a highly beneficial stabilizing effect on the film-cooling layer by generating stratification between the hot and cold gases therefore limiting mixing to a lower level. This lower level of mixing keeps a colder gas temperature near the insulating substrate inner wall, therefore reducing the heat transfer to the insulating substrate and the subsequent radially outward component (i.e. the rim-rotor). The film cooling itself, and the stabilization of the film cooling due to high centrifugal forces, are essential distinctions from rim-rotor prior art to insulate the thermal flux from the primary gas flow to the rim-rotor and provides about 50% of the benefit claimed by the insulating substrate. Furthermore, the inventive transpiration cooling utilizing a cooling flow inlet at a radius closer to the rim-rotor eliminates above 80% of the thermal stress gradient within the turbine blades compared to a configuration where the cooling flow inlet is further away from the rim-rotor, being from the hub and through the blades in the prior art, which is particularly important in ceramic blades that are subject to thermal shock.

Another advantage of this embodiment is the ability to design the cooling channels to direct the cooling flow to the higher heat flux region, which is typically the contact surface between the blade and the insulation substrate 184. It is preferred that the ratio between the cooling flow directed to the channels thermally connected to the contact surface of the blade and the total cooling flow is sized to match the heat flux ratio between the conduction from the blade and the convection under the insulation substrate. The heat flux ratio for this configuration is typically 50%, therefore the recommended cooling flow ratio directed over the blades is between 35 and 65%. All cooling flow can then be directed through the at least one main channel the front (or inlet side) 170, to the back 169 (opposite from the front side), or radially into the main flow through at least two orifices 168. Specific configurations requires that at least 5% of the totality of cooling fluid exits the at least one main channel through the at least two orifices located on the insulation substrate inner wall.

Another embodiment of a rim-rotor turbomachine further comprised of a rim-rotor cavity 152, a rotating boy and a static housing, utilizes fuels or inert gases to protect components from oxidative degradation at high temperature. In particular when oxidation sensitive rim-rotor materials such as carbon-fiber polyimide or carbon-carbon composites are used. The rim-rotor cavity 152 is filled with non-oxidative gases such as inert gases (nitrogen, helium) or non-oxidative fuels (e.g. hydrogen, methane, propane) to limit/prevent oxidation of the material. The fuels or inert gases will also concurrently reduce windage drag of rotating components. In particular, the rim-rotor 126 surfaces are moving at high relative velocities and generate frictional drag with fluids from surrounding environment. Drag is a function of gas density, hence filling the rim-rotor cavity 154 with gases having molecular weight preferably 40% lower than air, and specifically preferably 90% lower than air (e.g., methane, helium, hydrogen) minimizes drag. In order to minimize drag, whether the cavity contains air or other gases, the optimal radial and axial gap(s) 155 that minimizes windage losses is between 0.020 to 0.200 inches. The actual gap is a balance between viscous losses at a small gap and turbulence induced losses at large gaps.

A major obstacle in a functional rim-rotor turbine is due to the larger radial deformation between an annular rim-rotor and a classical prior art filled hub submitted to high rotational speed. The radial elongation of the rim-rotor is from 1 micron up to 2% of the rim-rotor inner radius and between 10 to 80 times larger depending on materials and exact geometries than the radial elongation of a filled hub. An innovative measure is to allow relative motion at the interface between the blades and the hub in a controlled manner in order to allow blades to follow the radial displacement of the rim-rotor while maintaining a sufficiently rigid connection between the blades and the hub to withstand dynamic effort during operation. The rigidity of the hub assembly in the radial-axial plane being at least 5 times larger than the shaft bending rigidity in the case of supercritical rotor to ensure the modal vibration due to the shaft rigidity do not excite the hub components. This has the advantage of decoupling the flexibility and the strength requirement of the hub. Decoupling the flexibility and the strength into two components also provides better material options for the hub to resist the high temperature at the contact point with the blade roots, and the potential to insulate the flexible component from the blade root.

Figure 19:
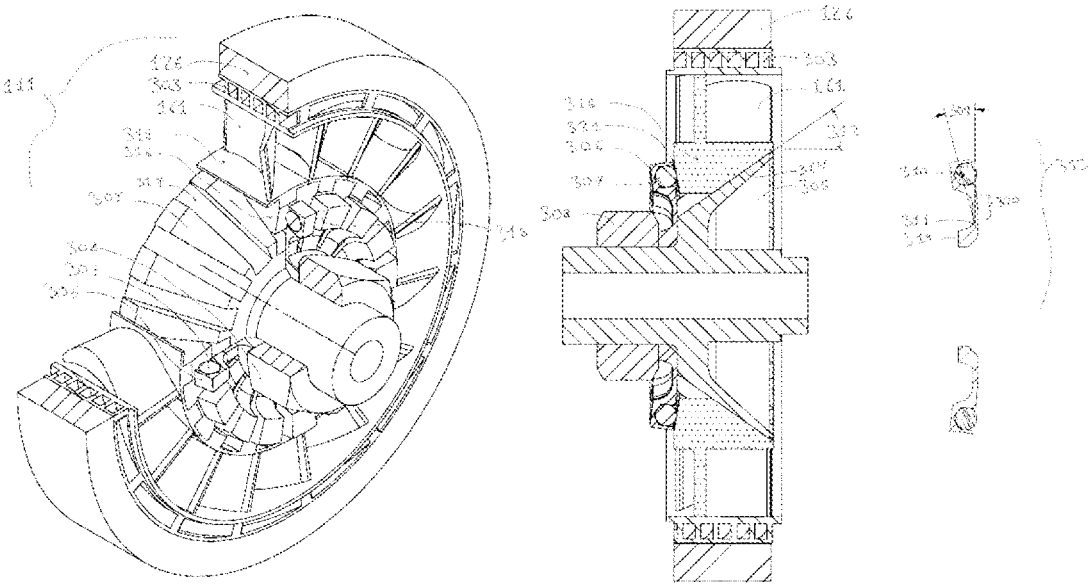
FIG. 19 is an embodiment of a rim-rotor turbomachine using a rim-rotor, insulation substrate, ceramic blades with a sliding plane below the root, a matching sliding plane hub and a spring-mass retainer.

FIG. 19 depicts an axial rim-rotor turbine rotating assembly 111, which includes a rim-rotor 126, a set of at least 2 blades 161 with inner shroud 315 and a blade root 316, an insulation substrate 303 between the blades and the rim-rotor, a hub 305, and a spring-mass retainer 306. The individual blades 161 are not retained by the hub like a classical gas turbine blade, and they are free to move radially to follow the radial expansion of the rim-rotor under rotation and maintain radial contact at their tips with the rim-rotor or intermediate component (i.e. insulation component). To ensure the turbine maintains its integrity under rotation and transfers the power to the turbine drive shaft connected to the hub, it is necessary that the blades stays in contact with the hub with high rigidity achieved by forcing the blades to move following a sliding plane 314 between the blade root 306 and the hub slots bottom surface 317. The sliding plane is angled from the turbine axial axis 312 which results in a preselected axial blade movement based on its radial displacement. The minimum angle 312 is based on the static coefficient of friction between the blade and hub material to ensure the blade will not jam on speed ramp down. A high angle 312 reduces the static friction necessary at maintaining a high rigidity under dynamic vibration. Therefore, angles between 15 and 75 degree are possible depending on materials and rigidity needs, with a preferred value of 35 degrees that provides sufficient margin on the static friction to avoid ceasing on rotational speed ramp down while ensuring the static friction is sufficient to avoid sliding due to unbalance forces. To maintain the blade root in contact with the sliding plane, an axial force is applied on the blade, preferably on the blade root backface 321. This axial force is created by a spring-mass component 306 in contact with the blade root that first bends by at least 2° into position when installed with a retainer part 308, depicted here by a nut, creating a spring effect resulting in an axial force on the blades root. To allow an axial relative position and motion of each blades while maintaining contacts, the spring-mass component has partial radial cuts 138 creating an individual beam spring 320 per blade attached to a spring-mass center ring 319 by each beam feet 311. As the turbine starts spinning, the blades start moving axially reducing the spring preload. To ensure sufficient force is maintained on the blade root during high rotational speed, an offset mass 310 is added at the end of the spring beam causing an angle 309 between the spring head center of mass 310 and the radial axis, resulting in an increase of axial force on the blade root when rotational speed increases (shown on the sliced cut view or the spring-mass 313). To ensure sufficient force is applied by the spring-mass during rotation, the mass head is between 10 and 50% of the blade assembly mass it makes contacts and where the angle 309 is between 3° and 30°, with a preferred angle of 15° which limits the radial forces being transferred while the creating sufficient axial forces for the assembly rigidity criteria. This configuration uses oxidation-resistant material at gas temperature above 900° C. such as ceramics for the blades with compressive loading where maximal tensile stresses are at 40% or less than the maximal compressive stresses. Those blades will conduct a large heat flux to the components in thermal communication. Due to the low centrifugal forces experienced by this hub, the hub can be made of oxidation-resistant material at gas temperature above 900° C. with tensile strength above 100 MPa at temperature above 900° C. (e.g., ceramics and/or ceramic-metal matrix composites and/or ceramic-matric composites, as compared to metallic alloys). In cases where small axial displacement are made possible (for example when high sliding plane angle are used), a low flexibility of the spring-mass would allow this component to be made of high temperature materials like ceramic. In the depicted case where higher flexibility of the spring component is required, a metallic superalloy can be used with reduced amount of air cooling by introducing an insulation piece between the spring-mass and the blade root, namely a ceramic coating, or a low conductivity ceramic pad or ball 307, reducing the spring-mass air cooling by 50%. The insulation has a secondary benefit of increasing the resistance to lateral friction seen at the contact point between the spring-mass and the blade by increasing the hardness by at least 50%.

Figure 20:
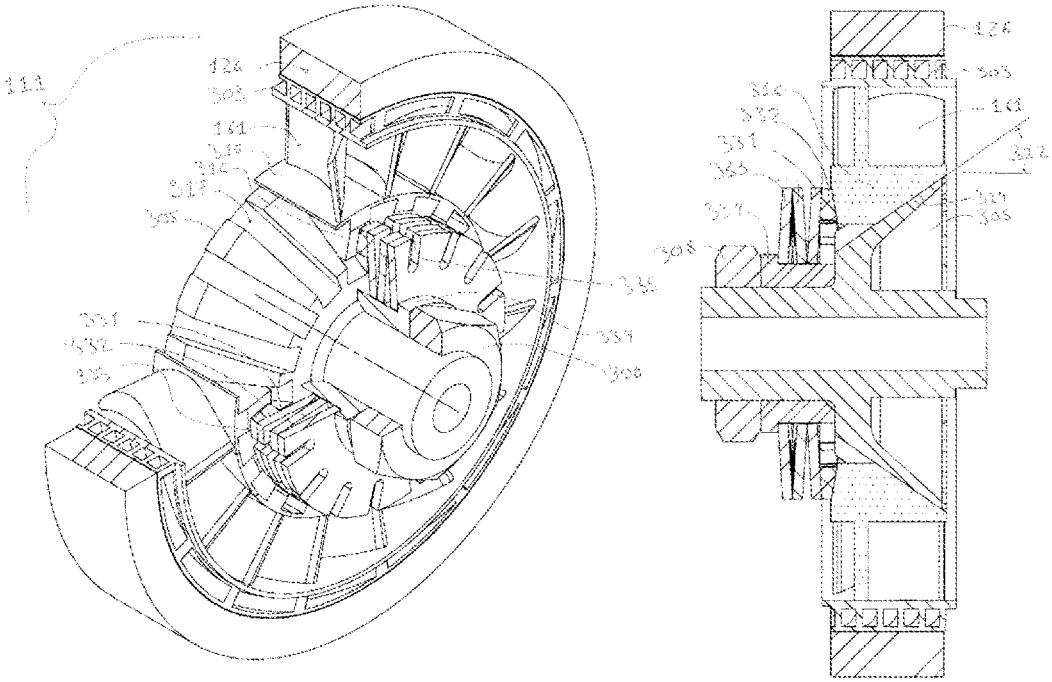
FIG. 20 is an embodiment of a rim-rotor turbomachine using a rim-rotor, insulation substrate, ceramic blades with a sliding plane below the root, a matching sliding plane hub and a spring loaded retainer.

FIG. 20 depicts a rim-rotor turbine rotating assembly 111 using the aforementioned sliding plane 314 principle, using a disc spring assembly of both 331 and 333 maintaining the axial force on the blade root 317. The primary disc spring 331 is in structural communication with the blade root, applying axial force based on the disc spring initial preload, given at assembly and maintained by a retaining component/feature 308, depicted here with the component being a nut. A stack of additional disc springs in series 333 can be added for added axial displacement, and/or in parallel for added rigidity. The disc spring can be partially cut radially 335 to allow relative axial position between 0.001 and 0.010 inches of one blade to the next one, without losing contact between the spring and any of the blades, which is required for the manufacturing and assembly tolerances. The primary disc spring can be further insulated from the blade heat by having an insulation ceramic pad 332 or coating applied between the spring and the blade. The spring type used is not limited to disc spring, and other types could be used to produce similar axial forces and displacement.

Figure 21:
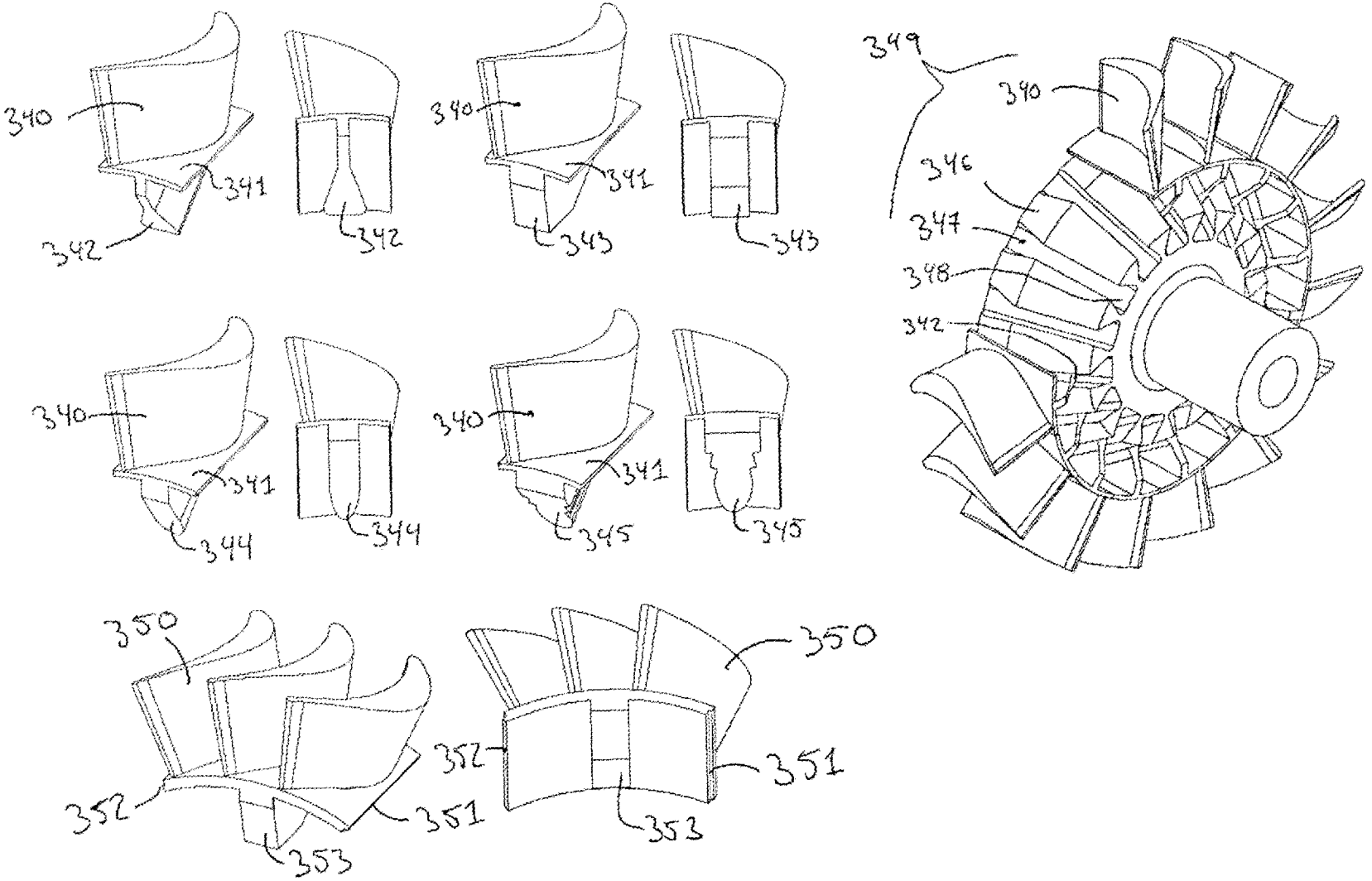
FIG. 21 is a variation of the blade root geometry for the sliding plane hub, including dovetail, rectangle, ellipse, fir-tree shapes.

FIG. 21 depicts another embodiment that proposes a different blade root shape option to generate a different sliding pattern, potentially beneficial in durability due to friction pattern, accumulation of residual particles away from the sliding plane and/or providing easier captive assembly features. A dovetail root 342, a rectangular root 343, a rounded root 344, a fir-tree 345 or other root shape perpendicular to the sliding plane can provide additional benefit in the sliding plane 347. As shown with only the blades and hub assembly 349, a female corresponding hub 346 would have the selected pattern blade root imprinted at the selected sliding plane 347 angle, depicted with the single dovetail root pattern 348. Additionally, the single blade 340 can be manufactured in one part with an inner shroud 341 and a root system comprised of 342 343 344 or 345, or all in individual parts assembled together in the turbine, or a hybrid comprised of multiple individual combination parts. In the case of the turbine with high blade density, it could be beneficial for packaging to use a single root attachment 353 for a series of blades 350. This arrangement can also reduce the number of inner shroud segments, therefore reducing the number of joints on the inner shroud. Those joints are leading to hot gas flow leaking inwards to the hub cavity, therefore overlapping feature like depicted on 351 and 352 might be required for sealing purposes.

Figure 22:
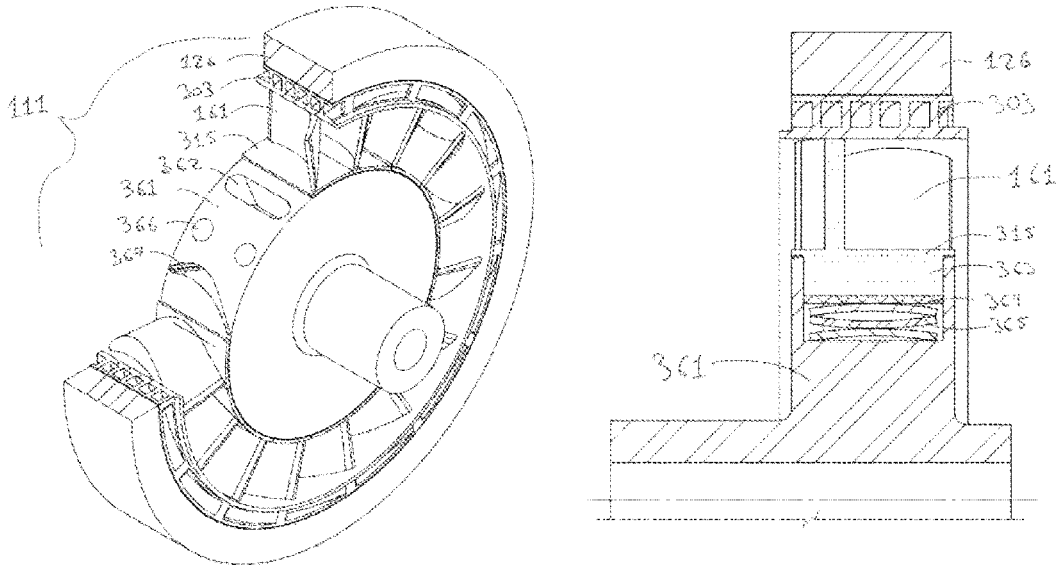
FIG. 22 is an embodiment of a rim-rotor turbomachine using a rim-rotor, insulation substrate, ceramic blades with a pin-and-socket relative motion below the male root (pin) and a female receptacle (socket) in the hub.

FIG. 22 depicts an embodiment of a rim-rotor turbine 111 using a pin-and-socket relative motion assembly. The blade root is a male extrusion (pins) 363 are inserted in the hub's 361 inside matching shaped female receptacle (socket) 362 providing support and friction to the blade root preventing angular movement while allowing radial movement, purposefully maintaining rotor structural integrity under rotation. To ensure consistent contact between the blade root 363 and the hub socket, a radial spring system is introduced in the socket cavity. The radial springs are designed to have sufficient spring back to stay in contact to both the hub 361 and the blade root 363 in all conditions of operation. An assembly of leaf springs 365 is depicted, but it is not limited to this option. Disc springs, coil springs, wounded springs, air springs, fingered dome springs are potential design that would provide the same function. Due to the low tensile stresses experienced by the hub 361 in this configuration, high temperature materials with low tensile strength such as ceramics are possible, allowing higher operating temperatures at the structural contact point between the blades and the hub. The springs can be made of ceramic or metallic superalloys. In the latter, an insulation pad or coating 363 is applied on the blade root at the structural contact location with the spring, where a heat flux is caused by heat conduction through the hub towards the shaft, or by air cooling the springs. The blade root is a planar extruded profile/shape that can be rectangular, rounded 362, one or more circular pins 366, the blade root profile itself. The matching socket is shaped to ensure structural contacts at with sufficient points to block all rotations and translation in all axes except the radial axis while allowing a slidefit throughout the operating envelope including all operating temperatures and rotational speed conditions.

Figure 23:
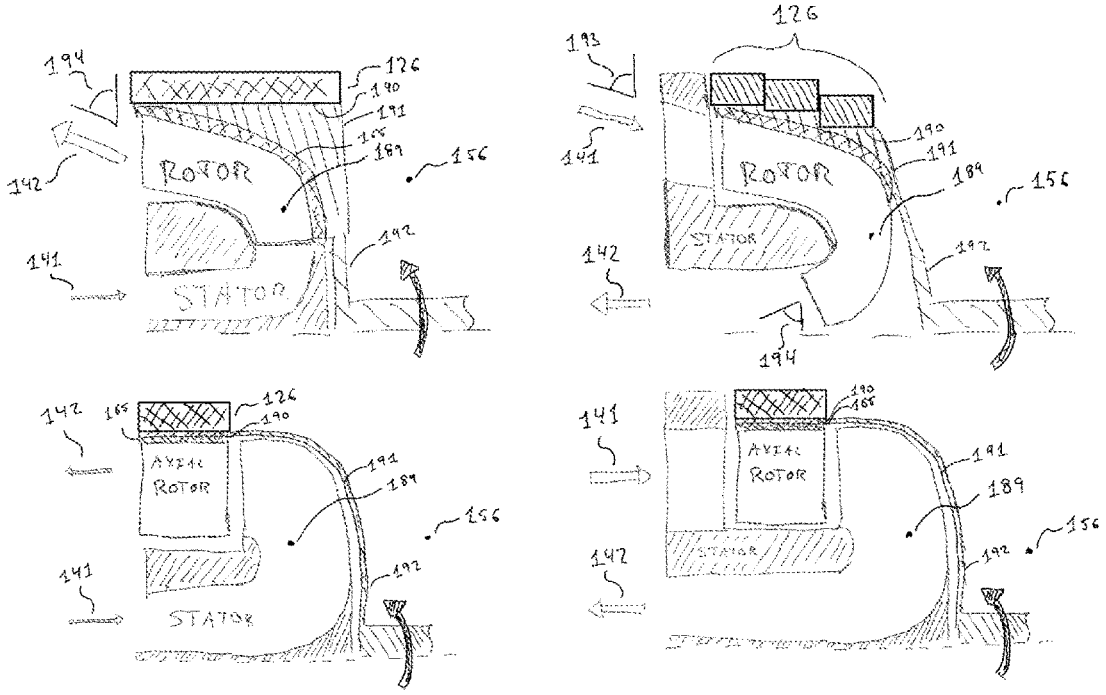
FIG. 23 is a schematic view of various rim-rotor turbomachine configurations that isolate the hot combustion gas from critical turbomachine components (shaft, bearings), essentially allowing "hubless" turbines.

In order to improve the thermal management of the turbomachinery, it is beneficial to isolate the main gas path from the shaft, bearings and other turbomachinery components. FIG. 23 depicts the general configurations that provides the isolated "gas" side 189 from the "shaft" side 156. Those configurations all provide the advantage of not having a structural component in contact with the bottom of the blade (void from the hub or "hubless"), providing easier thermal implementation with ceramic blade (e.g. Si3N4, SiC), especially in configuration where hot combustion exhaust products gases are acting on the at least two blades in the "gas" side 189, and the advantage of a lighter structure, therefore able to achieve higher tangential speed of the hot gas path meanline in excess of 400 m/s. The connection between the blade and the shaft is made through the rim-rotor 126 or through the counter-flux thermal insulating substrate 165. The main flow inlet 141 can either be located at the inner radius or the outer radius, and the main flow exit 142 is at the opposite. Both pure axial flow, and partially radial flow (also known as mixed flow) configuration are possible. In the mixed flow configuration, the inlet angle 193 can be at a range of angles between 0 and 90 degrees relative to the radial plane, with a preferred 45 degree to maximize the ratio of inlet radius over exit radius while maintaining structural integrity. The exit angle 194 can also be at a range of 0 to 90 degrees. The gas side 189 circumscribes the rim-rotor's inner surface 190 and a side face 191 of the connecting element 192.

A rim-rotor axial turbine configuration requires the hot gas path to surround the rim-rotor, which is especially problematic for recuperated cycles where the exhaust is re-circulated into the heat-exchanger, coupling the exhaust gas with the fresh air path. Due to the limited temperature resistance of the rim-rotor, including rim-rotors comprised of a fiber (e.g., carbon) polymer rim-rotor, the surroundings of the rim-rotor must be maintained at low temperatures. Therefore, our inventive configuration keeps the hot gas flow path on only one side of the rim-rotor and a cooler section on the other side of the rim-rotor providing considerable cooling and thermal protection advantages, effectively increasing the cycle efficiency and rim-rotor reliability. The configuration provides this thermal separation having similarities to radial and mixed flow turbines, but including a change in flow direction in the meridional plane greater than prior art mixed flow and radial turbines, therefore effectively creating a reversed mixed flow turbine (RMFT). The meridional plane is defined as a plane cutting a turbomachine through a diametral line and the rotating axis. The embodiments are not limited to a single rim-rotor on the outside of the turbine, it can utilize an assembly of multiple (i.e., at least two) rim-rotors providing higher radial preloading as necessary or varying material compositions providing different functions of each material. It is understood that the depictions in the figures are for turbines/expanders but in fact any turbo-machinery including compressors.

Figure 24:
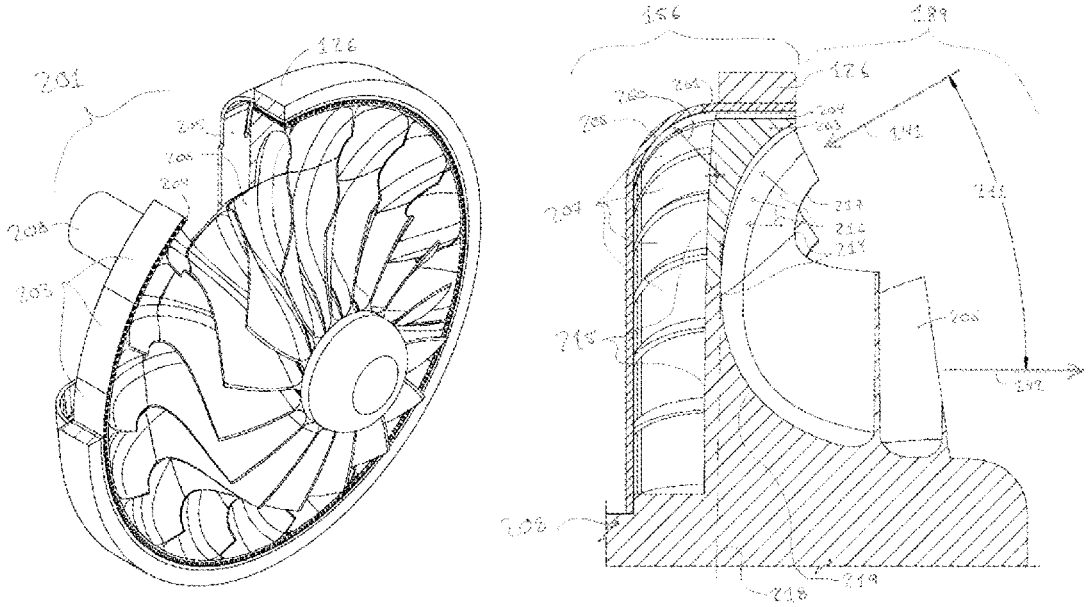
FIG. 24 is an embodiment of a rim-rotor turbomachine in a reversed mixed flow configuration using an outer section of split blades and an inner section in a single part, where the rim-rotor is in structural communication with the shaft by a hub with an array of radially compliant springs.

FIG. 24 depicts a rim-rotor reversed mixed flow turbine assembly 201. Hot gas flow meridional inlet 141 forms an angle 211 smaller than 90° from the hot gas flow meridional outlet 142. In this configuration the hot gas flow makes a change in direction in the meridional plane between 120° and 180°, preferably 150° (calculated as 180° minus the inlet to outlet angle 211). This is larger than the 90° change in direction of radial turbines, much larger than regular mixed flow turbine which are between 0° and 90°, and naturally larger than axial flow turbine where there is no change in direction (0°). Such change in direction provides a definitive separation between the "gas side" 189 and the "shaft side" 156, enabling a more effective cooling feature 204 and cooler environment around the rim-rotor 126. This large change in direction also generates a pressure gradient 216 as the flow turns reducing pressure at the turbine blade tip 217, effectively reducing tip leakage and associated efficiency losses. The turbine blades are split into two sections, preferably at the point 214 where the meridional blade curvature 219 is tangent with a radial line 218, to form an outer section that is mostly in compressive loading by being forced outward during rotation into the rim-rotor 126, and an inner section 206 that is in tensile loading by being retained at its center. This separation generates an outer section maximal tensile stresses that are at 40% or less than the maximal compressive stresses, and an inner section maximal compressive stresses that are at 40% or less than the maximal tensile stresses. The outer section is subsequently split into at least two separated blade sections 203 to avoid any circumferential stresses in those parts, allowing oxidation-resistant material at gas temperature above 900° C. such as ceramics to be used. The inner section 206 is a single part containing the exducer section of the blades, and makes a structural connection to the turbine shaft 208. The exducer is the exit blade section that provides the rotor exit angle at the rotor exit for the flow to minimize energy losses at the turbine exit and following diffuser. The lower tangential speed of the exducer section, relative to the turbine tip speed, considerably reduces the stresses in the component compared to traditional single part radial turbines, allowing oxidation-resistant material at gas temperature above 900° C. with tensile strength material above 100 MPa at temperature above 900° C. such as monolithic ceramics, especially Si3N4 or SiC, and ceramic matrix composites (CMCs), to be used for this component. Since the rim-rotor 126 radial elongation under rotation from 1 micron up to 2% of the rim-rotor inner radius and between 10 to 80 times larger depending on materials and exact geometries than the radial elongation of the exducer section 206 backface, a flexible connection must maintain contact between the blades, the rim-rotor and the exducer or directly between the rim-rotor, turbine blades and the turbine shaft to ensure the turbine structural integrity is maintained under rotation. A flexible hub 205 that connects the rim-rotor 126 and the blade outer section 203 to the turbine shaft 208 requires advance design features to ensure flexibility, rigidity and strength are sufficient to operate at high rotational speed. One exemplary design feature is using an array of radially compliant springs 207 comprised of a cantilevered beam in the radial-axial plane, such as for a functional isotropic material, namely most metallic alloys and specific ceramics. Components in the "shaft side" 156, which includes the hub, rim-rotor and not depicted turbomachine component like bearing(s), electric generator, compressor(s), can be further insulated from the hot components by having a thermal barrier coating or insulation component(s) 215 applied onto the backfaces of the blades outer section 203 and inner section 206.

Another exemplary embodiment for the turbine connection is further detailed in

Figure 25:
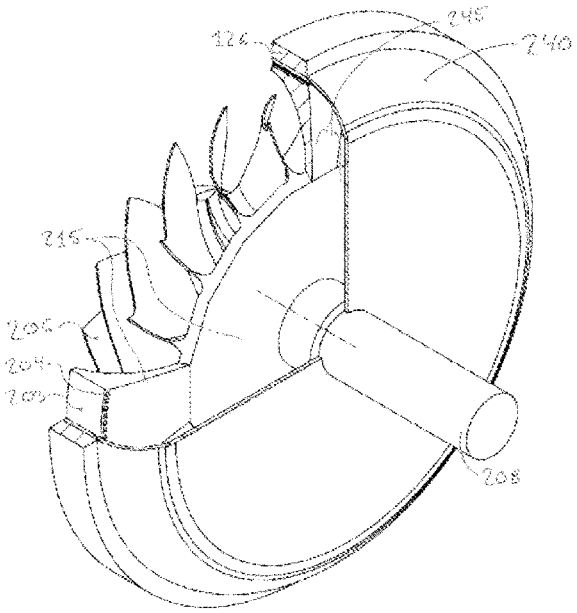
FIG. 25 is an embodiment of a rim-rotor turbomachine in a reversed mixed flow configuration using an outer section of split blades and an inner section in a single part, where the rim-rotor is in structural communication with the shaft by a thin hub made of orthotropic material.

FIG. 25, with a radially deformable thin dome hub 240 based on orthotropic material properties to control deformation and strength respectively in the radial and axial axis. The thickness 261 of the dome is between 2.5 and 25% of the rim-rotor thickness, preferably 10%, and its curvature in the axial-radial plane 260 is between 15 and 50% of its outer radius. A dome hub provides an improved and easier sealing capability of the inner cavity 245 then an array of compliant springs, therefore reducing drag, particularly preferred drag reduction of 66%, by avoiding air flow exiting and entering the cavity 245. A fiber-polymer composite, including a carbon fiber, is the preferred high strength orthotropic material where the fiber placement adjusts the rigidity in all axes, i.e. radially, axially and tangentially. An exemplary method is a placement of the composite layers on a domed mold with layers made at angles between 0 and ±90 degrees between the axial axis and the fibers, preferably at repeated layers at +45 then −45 degree, notably by using the preferred filament winding technique. This fiber placement allows above 1.5% elastic deformation in the radial-axial plane, and specific strength above 200 MPa/(g/cm3) in the radial-axial plane to support its own mass. The dome hub 240 is depicted to be inserted between the rim-rotor 126 and the outer blade sections 203, but attachment with the dome hub on the outside of the rim-rotor or on the side, or even between the blade section and the cooling features 204 are also options, depending on the hub material composition.

Figure 26:
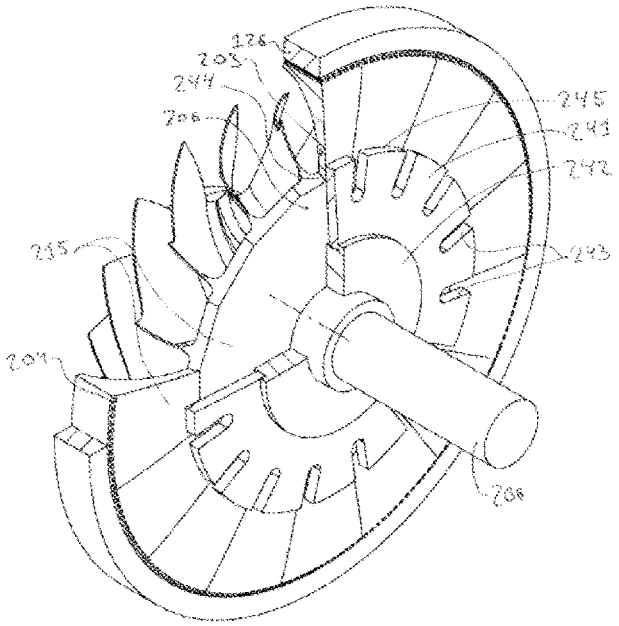
FIG. 26 is an embodiment of a rim-rotor turbomachine in a reversed mixed flow configuration using an outer section of split blades and an inner section in a single part, where the rim-rotor is in structural communication with the inner section through the blades that are maintained in contact with a sliding plane by a rear spring mechanism.

As shown on FIG. 26, the integrity of the turbine can be also maintained by introducing a sliding planes 244 between the base of each turbine blade outer section 203 and the inner section 206. This angled sliding plan between 15° and 75°, preferably 35°, from the axial axis allows the blade to move freely radially while maintaining contact with the inner section. A spring system, which includes a spring 241 and a preloading and locking mechanism 242, ensures an axial force is applied at the back of the blade so the contact on the sliding plane is maintained with sufficient friction that the turbine keeps its structural integrity under rotation. The depicted spring 241 is a disc spring with partial radial cuts 243 to allow a relative axial position and motion of each blades. Exemplary features to provide the axial force include raw disc springs, coil springs, wounded springs, air springs, fingered dome springs, magnetic or hydraulic mechanism are potential design that would perform the same functions. An insulation component or coatings could be applied at the contact point 245 in the instance where the blade outer section is made of ceramic and the springs are metallic.

Figure 27:
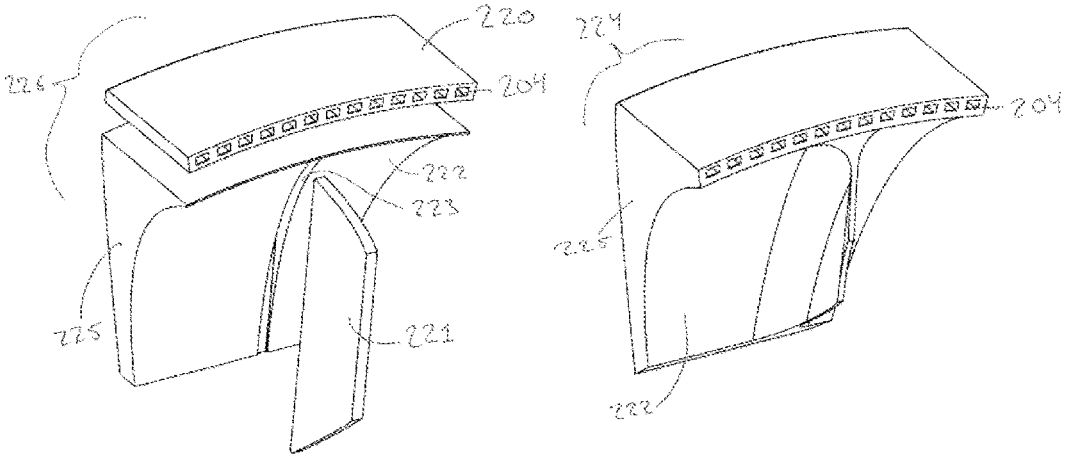
FIG. 27 is a variation in the outer section blade where it is split into an insulation substrate, a rear wall flow guide and a blade.

The individual outer blade sections are further detailed on FIG. 27. An integrated outer section 224 provides simplicity during the assembly. Flexibility in material selection for each function is better achieved with a separated outer section 226, which includes the insulation substrate 220 with insulation and cooling features 204, the rear wall flow guide 222, and the blade 221 inserted in a blade holder 223. The outer blade section 203 has at most one rear wall flow guide per blade, but can also include multiple blade per rear wall flow guide portion. The rear flow guide 222 can be made of a metallic superalloy with oxidation-resistant thermal barrier coatings while the blade 221 is made from oxidation-resistant material at gas temperature above 900° C. such as ceramic. Reducing mass of the outer blade section 203, which leads to lower stresses in the rim-rotor 126, is achieved by making the rear wall flow guide partially hollow by removing non-loaded material sections.

Figure 28:
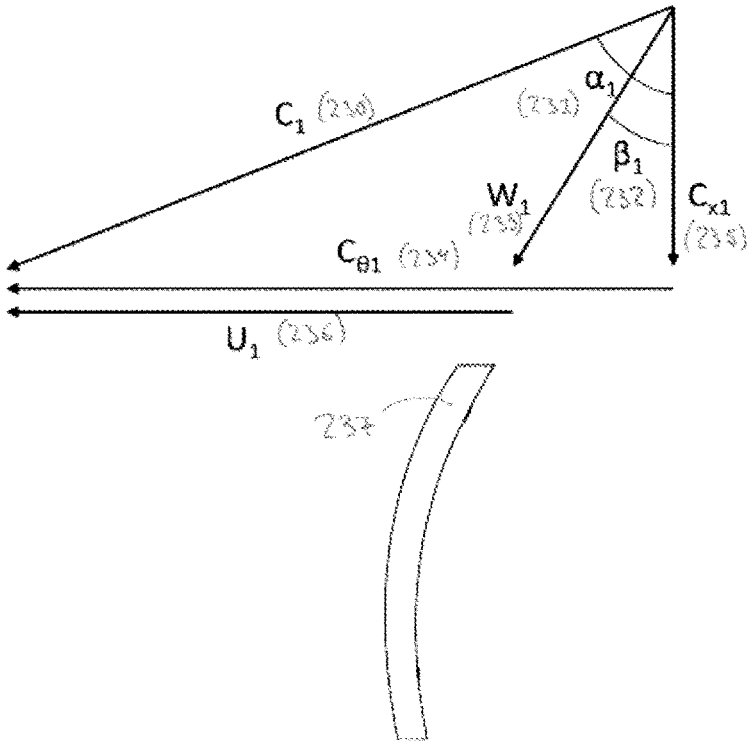
FIG. 28 is a mixed flow turbine inlet velocity triangles that can be used with reversed mixed flow turbines.

FIG. 28 shows a typical mixed flow turbine inlet velocity triangles. The advantage of the mixed flow turbine as compared to a purely radial turbine is the capability to create a positive inlet blade angle 232 while using purely radial blades, meaning that all sections of the blade are attached radially to the supportive section. This advantage is carried over to the rim-rotor reversed mixed flow turbine configuration since the inlet flow has an axial velocity component. The outer section of the reverse mixed flow turbine blade 237 is shown in the inlet tangential plane, where the positive blade angle 232 allows the inlet flow tangential speed 234 to be larger by at least 5%, preferably 22%, than the inlet blade tip velocity 236, resulting in an increased specific power for the same stage efficiency, ultimately resulting in a more compact and efficient engine.

Figure 29:
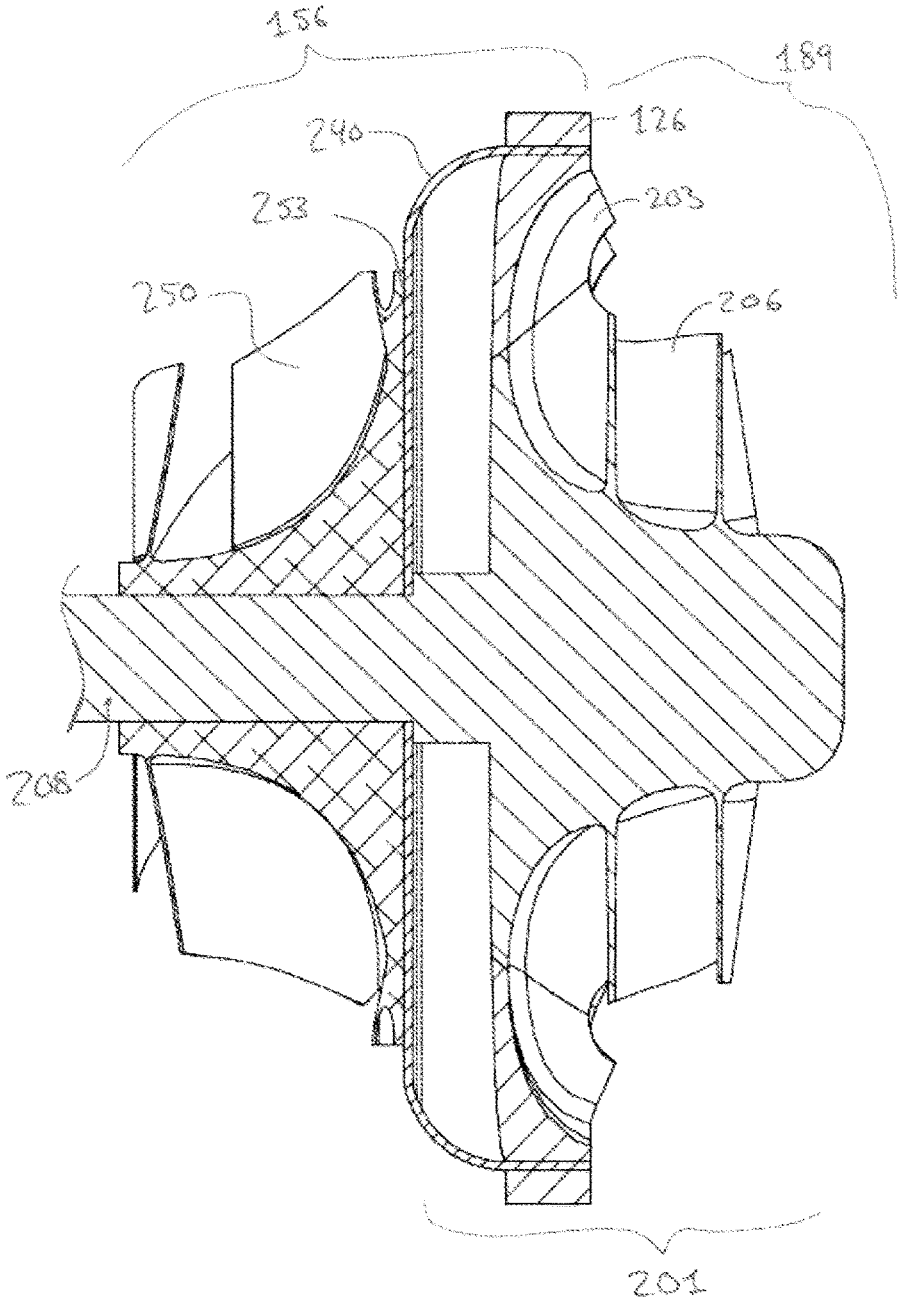
FIG. 29 is a highly compact turbomachine design where a centrifugal compressor is mounted back-to-back with the reversed mixed flow turbine.

FIG. 29 illustrates a highly compact turbomachine design where a centrifugal compressor 250 is mounted back-to-back with the reversed mixed flow turbine 201, where the distance between the compressor and the radial turbine backfaces is less than 50% of the turbine rim-rotor radius. Such a compact configuration can be connected to a load or an electric generator on an extension of the turbine shaft 208 where both the compressor and turbine mass are overhung from the bearings. The high compactness provides a reduction in mass of the turbomachine of a least 5% by reducing thermal insulation needs. Installing the compressor and turbine back faces 253 back-to-back removes the drag loss induced between the back faces and a static component preferably reducing the drag by up to 100% versus the configuration where the compressor and turbine are installed separately (i.e., not back to back). In this configuration, the hot section "gas side" 189 is kept on one side of the machine, and the cooler section 156 is on the other side, reducing thermal heat losses and importantly reducing cooling air requirements notably on the fiber-polymer rim, therefore increasing system efficiency.

The high g-field combustor is a key inventive component with the embodiment of a rim-rotor turbomachinery, most notably when the rim-rotor turbomachinery is a ceramic turbomachinery with high tip speed (e.g. compressor, turbine, rotating ramjet, or rotating combustors). Although the invention has been described in detail with particular reference to certain embodiments detailed herein, other embodiments can achieve the same results. Variations and modifications of the present invention will be obvious to those skilled in the art and the present invention is intended to cover in the appended claims all such modifications and equivalents.

What is claimed is:

1. A rim-rotor turbine rotating assembly comprising:

a hub adapted to be mounted or connected to a rotating shaft;

a rim-rotor, the rim-rotor including at least one continuous ring; and a plurality of blades with each of the plurality of blades contacting the rim-rotor, each of the plurality of blades operatively connected to the hub by a sliding contact with the hub allowing at least a radial motion between the blades and the hub to compensate for rim-rotor radial deformation under centrifugal loads;

wherein the blades are ceramic blades and the continuous ring is in a material different than that of the blades, wherein the sliding contact is defined by complementary sliding surfaces between the hub and the blades, and wherein the complementary sliding surfaces are at an angle ranging between 15 to 75 degrees inclusively, the angle being from a rotational axis in a radial-axial plane in which the rotational axis lies.

2. The rim-rotor turbine rotating assembly of claim 1, wherein the blades are axial-flow blades for an axial fluid flow.

3. The rim-rotor turbine rotating assembly of claim 1, wherein the complementary sliding surfaces are at an angle of 35 degrees from the rotational axis in the radial-axial plane in which the rotational axis lies.

4. The rim-rotor turbine rotating assembly of claim 1, wherein at least two blades are joined together into a single part having a common inner shroud and a common root.

5. The rim-rotor turbine rotating assembly of claim 1, further including at least one spring to retain the plurality of the blades in compression loading against the rim-rotor through the sliding contact with the hub.

6. The rim-rotor turbine rotating assembly of claim 5, wherein the at least one spring applies at least one contact force on blades at the blade roots.

7. The rim-rotor turbine rotating assembly of claim 5, wherein the at least one spring applies a force on the blades that is generally perpendicular to the rotational axis, the at least one spring being radially under each of the blades.

8. The rim-rotor turbine rotating assembly of claim 5, wherein the at least one spring includes a plurality of springs each applying an independent biasing force on a respective one of the blades.

9. The rim-rotor turbine rotating assembly of claim 5, wherein the at least one spring is at least one of a leaf spring, a disc spring, a coil spring, a wounded spring, an air spring, and a fingered dome spring.

10. The rim-rotor turbine rotating assembly of claim 5, further comprising an insulation material between the at least one spring and the blades.

11. The rim-rotor turbine rotating assembly of claim 10, wherein the insulation material is at one of a ceramic coating, a low conductivity ceramic pad or a ceramic ball.

12. The rim-rotor turbine rotating assembly of claim 5, wherein axial contact forces on the blades are provided by using a radial centrifugal force on a spring head converted to an axial force by locating the spring head further away from the hub than a spring attachment point on the shaft.

13. The rim-rotor turbine rotating assembly of claim 5, wherein the at least one spring includes a spring-mass retainer having a compliant spring beam and a mass for each of the blades, with a physical contact point with the blades at an extremity of the compliant spring beam, with a center of the mass being offset from the spring beam to create an increasing axial force for an increasing rotational speed, and whereby an angle made by a line passing through the mass center and the spring bream being between 3 and 30 degrees from a radial axis.

14. A rim-rotor turbine rotating assembly comprising:

a hub adapted to be mounted or connected to a rotating shaft;

a rim-rotor, the rim-rotor including at least one continuous ring;

a plurality of blades with each of the plurality of blades contacting the rim-rotor, each of the plurality of blades operatively connected to the hub by a sliding contact with the hub allowing at least a radial motion between the blades and the hub to compensate for rim-rotor radial deformation under centrifugal loads;

at least one spring to retain the plurality of the blades in compression loading against the rim-rotor through the sliding contact with the hub; and an insulation material between the at least one spring and the blades;

wherein the blades are ceramic blades and the continuous ring is in a material different than that of the blades, and wherein the insulation material is at one of a ceramic coating, a low conductivity ceramic pad or a ceramic ball.

15. The rim-rotor turbine rotating assembly of claim 14, wherein the blades are axial-flow blades for an axial fluid flow.

16. The rim-rotor turbine rotating assembly of claim 14, wherein at least two blades are joined together into a single part having a common inner shroud and a common root.

17. The rim-rotor turbine rotating assembly of claim 14, wherein a shape of blade roots of the blades complementarily matches a shape of hub surfaces to create a complementary male-female engagement creating the sliding contact.

18. The rim-rotor turbine rotating assembly of claim 14, wherein the at least one spring applies at least one contact force on blades at the blade roots.

19. The rim-rotor turbine rotating assembly of claim 14, wherein the at least one spring applies a force on the blades that is generally perpendicular to the rotational axis, the at least one spring being radially under each of the blades.

20. The rim-rotor turbine rotating assembly of claim 14, wherein the at least one spring includes a plurality of springs each applying an independent biasing force on a respective one of the blades.

21. The rim-rotor turbine rotating assembly of claim 14, wherein axial contact forces on the blades are provided by using a radial centrifugal force on a spring head converted to an axial force by locating the spring head further away from the hub than a spring attachment point on the shaft.

* * * * *